US011358689B2

(12) United States Patent
Williams

(10) Patent No.: US 11,358,689 B2
(45) Date of Patent: Jun. 14, 2022

(54) YACHT PRESERVER

(71) Applicant: Jeremy Williams, Pensacola, FL (US)

(72) Inventor: Jeremy Williams, Pensacola, FL (US)

(73) Assignee: YACHT PRESERVER, INC., Pensacola, FL (US)

( * ) Notice: Subject to any disclaimer, the term of this patent is extended or adjusted under 35 U.S.C. 154(b) by 0 days.

(21) Appl. No.: 17/075,910

(22) Filed: Oct. 21, 2020

(65) Prior Publication Data

US 2021/0031888 A1 Feb. 4, 2021

Related U.S. Application Data

(63) Continuation-in-part of application No. 16/536,369, filed on Aug. 9, 2019, now abandoned, which is a continuation-in-part of application No. 15/806,526, filed on Nov. 8, 2017, now Pat. No. 10,421,526.

(60) Provisional application No. 62/419,191, filed on Nov. 8, 2016.

(51) Int. Cl.

| | |
|---|---|
| ***B63B 43/16*** | (2006.01) |
| ***B63C 7/00*** | (2006.01) |
| ***B63B 7/00*** | (2020.01) |
| ***B63B 3/14*** | (2006.01) |
| *B63B 43/12* | (2006.01) |

(52) U.S. Cl.
CPC ..... *B63C 7/00* (2013.01); *B63B 3/14* (2013.01); *B63B 7/00* (2013.01); *B63B 2043/126* (2013.01)

(58) Field of Classification Search
CPC ..... B63B 43/16; B63B 2043/126; B63B 2043/145; B63B 3/14; B63C 7/00
See application file for complete search history.

(56) References Cited

U.S. PATENT DOCUMENTS 6,467,421 B1 * 10/2002 Conley ..... B63B 43/16 114/227

FOREIGN PATENT DOCUMENTS

CN 109080785 A * 12/2018

* cited by examiner

*Primary Examiner* — Andrew Polay
(74) *Attorney, Agent, or Firm* — Christopher A. Proskey; BrownWinick Law Firm

(57) ABSTRACT

A nonlimiting example of a yacht preserver includes a handle, an inflator device connected to an upper end of the handle and an inflatable bladder connected to a lower end of the handle. In this nonlimiting example, the inflator device includes a gas canister that is connected to the inflatable bladder by a tube and is configured to deliver gas to inflate the bladder upon activation. The yacht preserver may be used to seal an opening of a yacht by placing the uninflated bladder near the opening in the yacht and activating the inflator device allowing the bladder to expand to seal the opening.

19 Claims, 30 Drawing Sheets

YACHT PRESERVER

REFERENCE TO RELATED PATENT APPLICATIONS

This patent application is a continuation in part of U.S. Utility application Ser. No. 16/536,369 filed on Aug. 9, 2019 and titled YACHT PRESERVER, which is a continuation in part of U.S. Utility application Ser. No. 15/806,526 filed on Nov. 8, 2017 and titled YACHT PRESERVER, which claims priority to U.S. Provisional Patent Application Ser. No. 62/419,191 filed on Nov. 8, 2016, the entirety of each is incorporated herein fully by reference.

FIELD OF THE INVENTION

Example embodiments relate to a yacht preserver and a method of using the yacht preserver to seal an opening of a yacht.

OVERVIEW

The term yacht used herein is intended to describe any form of a floating device, such as a boat or ship, or the like, whether large or small. Yachts are a recreational boats or ships that come in various sizes, shapes and designs. Some are powered, others rely on wind, while others rely on both. Common among many yachts is that they have a hull that floats on the water. Many yachts have openings in the hull at or below the water line to facilitate expulsion of exhaust, bilge water or the like. In the event of damage to the yacht's mechanical systems, such as a broken exhaust pipe, or during maintenance, these openings may allow water to enter the yacht leaving the yacht prone to sinking. Most yachts, however, reduce the risk of sinking by having one or more pumping systems (for example, a bilge pumping system) to remove water from the yacht. However, in the event of a catastrophic break or failure of the pumping system the influx of water may sink the yacht. As such a need exists, in these situations, to selectively seal an opening in a yacht to prevent the yacht from sinking

SUMMARY

It is recognized that pumping systems greatly reduce a yacht's risk of sinking. However, in the event a pumping system fails or cannot keep up with water flowing into the yacht, the risk of sinking greatly increases. In addition, certain emergency conditions can develop, such as when an exhaust line breaks, that can cause a sudden rush of water into the yacht. In addition, yachts periodically require maintenance that requires plugging of openings in the hull of the yacht, such as when a motor needs to be repaired or replaced. In order to reduce the risk of sinking the inventor developed a yacht preserver. The yacht preserver is designed to prevent an inflow of water through an opening in the yacht. The yacht preserver includes an inflator device which may expand to seal an opening. The inflator device may include a gas canister, for example, a carbon dioxide canister, and a bladder (for example, an air bag) configured to expand under the influence of gas provided by the gas canister. The inflator device may be placed near or in an opening in the side of a yacht, for example, an exhaust opening, to seal the opening thus preventing water from entering the yacht through that opening.

In one or more arrangements, the system includes a handle, an inflator device, a hose, and an inflatable bladder.

The handle has an elongated shape extending from an upper end to a lower end. The inflator device connected to the handle at a position proximate to the upper end. The inflator device has a gas canister and an activation device. The inflatable bladder is attached to the lower end of the handle. The hose has one end connected to the inflator device and a second end connected to the bag. Upon activation of the activation device, the inflator device is configured to pass pressurized air from the gas canister through the hose to the inflatable bag, thereby inflating the inflatable air bladder and thereby sealing the opening in the yacht.

In one nonlimiting example embodiment, the activation device may include an actuator, such as a button, lever, pull-cord, trigger, or the like to trigger the canister to release gas to expand the bladder. In another embodiment, the activation device includes a pull handle which may be used to trigger the canister to release gas to expand the bladder. In yet another embodiment, activation device includes a handle with an actuator to trigger the canister as well as a pull handle to trigger the canister.

One clear advantage of the yacht preserver is its ability to quickly prevent water from flowing through an opening in the side of a yacht. For example, in one embodiment, a user may grab a handle of the yacht preserver and use it to place the container or bag enclosing the inflator device near or in an opening in the side of a yacht. The user may then activate the gas canister causing the bladder of the inflator device to expand and seal the opening. This is a relatively quick and easy process which may allow an opening to be sealed within a matter of seconds.

BRIEF DESCRIPTION OF THE DRAWINGS

Example embodiments are described in detail below with reference to the attached figures, wherein.

DETAILED DESCRIPTION

Figure 1:
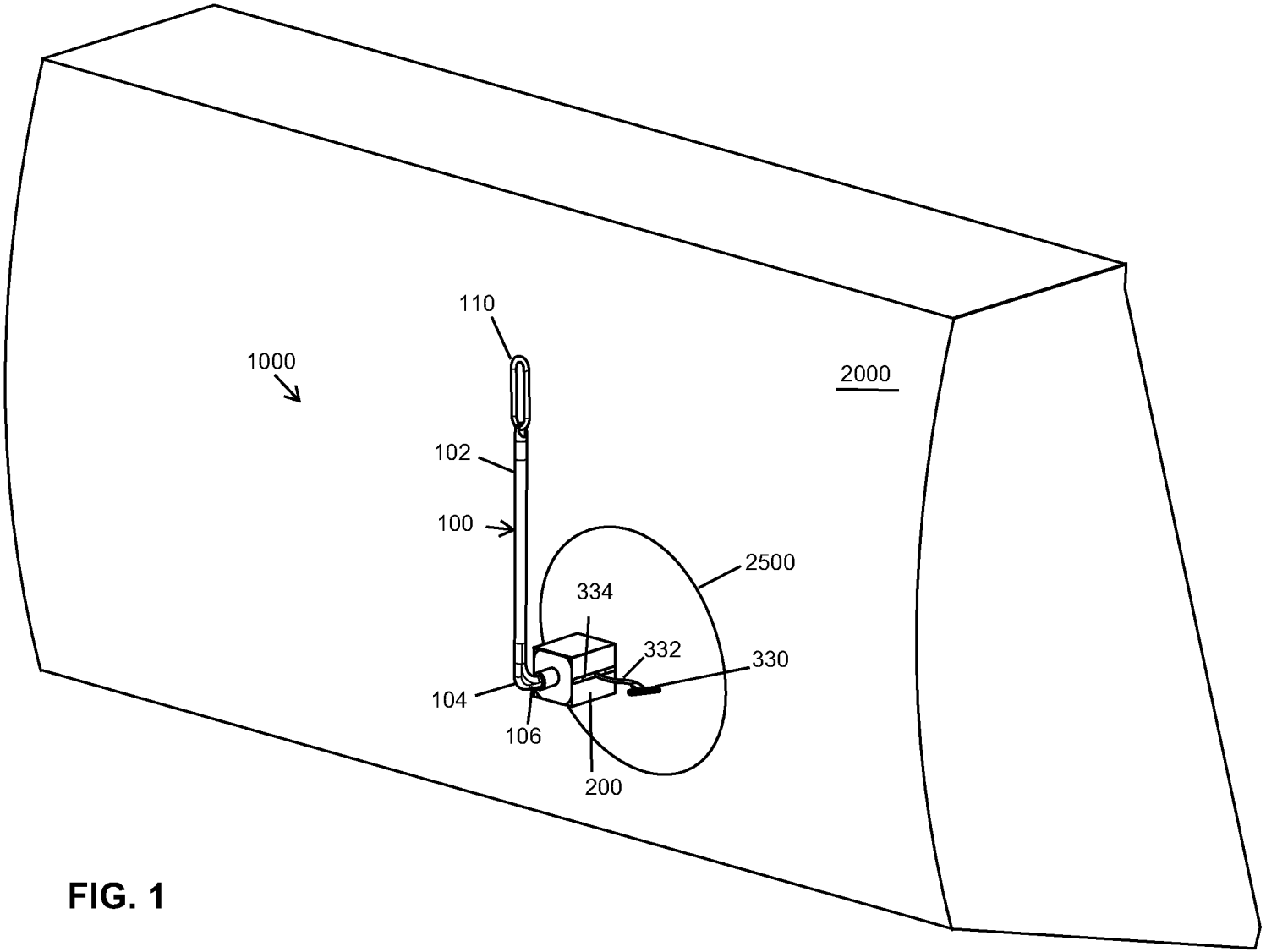
FIG. 1 is a perspective view of an example yacht preserver arranged near an opening in a side of a yacht; the view showing the yacht preserver having a handle that connects at its lower end to a container that houses an inflatable air bladder and an inflator device; the view showing a cord extending through a slot of the container that is connected to a pull handle that initiates air flow from a gas canister into the air bladder; the view showing the yacht preserver in a pre-deployed state with the container in a closed position; the view showing the container of the yacht preserver having a generally square or rectangular shape

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "either A or B". As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of a system and method for sealing an opening in a yacht. However, the embodiments are not so limited. It is appreciated that the embodiments may be adapted for use in various other reclamation applications, which may be improved by the disclosed structures, arrangements and/or methods. For example, it is contemplated that the disclosed structures, arrangements and/or methods may be used across a variety of industries, products, purposes, applications and the like. For example, structures, arrangements and/or methods applied to smaller water craft or even automotive and/or aerospace industry or in any application where an inflatable bladder is applicable. In this sense, the yacht preserver may be thought of more broadly as an inflator operating and positioning device configured to allow a user to position an inflator device near an opening to seal the opening. The system is merely shown and described as being used in the context of sealing an opening in a yacht as one of countless examples.

Generally, example embodiments relate to a yacht preserver system 1000 and a method of sealing an opening 2500 in a yacht 2000. Opening 2500 in yacht 2000 may be any opening such as an exhaust tube opening, a port hole, a puncture in a boat hole, or any other opening. This opening 2500 may be in any portion of a boat hull such as the side, transom or back, bottom or any other portion of the boat. As such, the term opening 2500 is not meant to be limiting to any one type of opening in any particular position. Instead, the term opening as is used herein is intended to be interpreted broadly and includes any opening. Similarly, the term yacht 2000 is not meant to be limiting to any type of a vessel and in fact reference to a yacht 2000 is only by way of example. It is understood that the yacht preserver system 1000 may be used to prevent water from entering a yacht 2000, but it can also be used with any other mechanical device or system and can be used to seal any opening for any reason, such as to keep weather out of the opening, keep animals out of the opening, or for any other purpose.

FIG. 1 is a view of a yacht preserver system 1000 in accordance with a non-limiting example of the invention. As shown in FIG. 1, the yacht preserver system 1000 may be arranged near an opening 2500 of a yacht 2000. In the non-limiting example of FIG. 1, the yacht preserver system 1000 includes a handle 100 with a container 200 arranged at an end of the handle 100. The container 200, as will be explained further herein, in one arrangement, encloses an inflator device 300 and bladder 320 which may be used to seal the opening 2500 of the yacht 2000. In another arrangement, inflator device 300 is exterior to container 200 which encloses and seals bladder 320. In this non-limiting example, the handle 100 of the yacht preserver system 1000 includes a lanyard 110 which may slip over a user's wrist to help the user maintain control of the yacht preserver system 1000. The lanyard 110 may also help prevent the yacht preserver system 1000 from slipping out of the user's hand and falling into the water. However, in one or more arrangements, lanyard 110 and may be omitted, replaced or augmented by another structure such as a grip, clasp, hook, loop, or the like.

Figure 2:
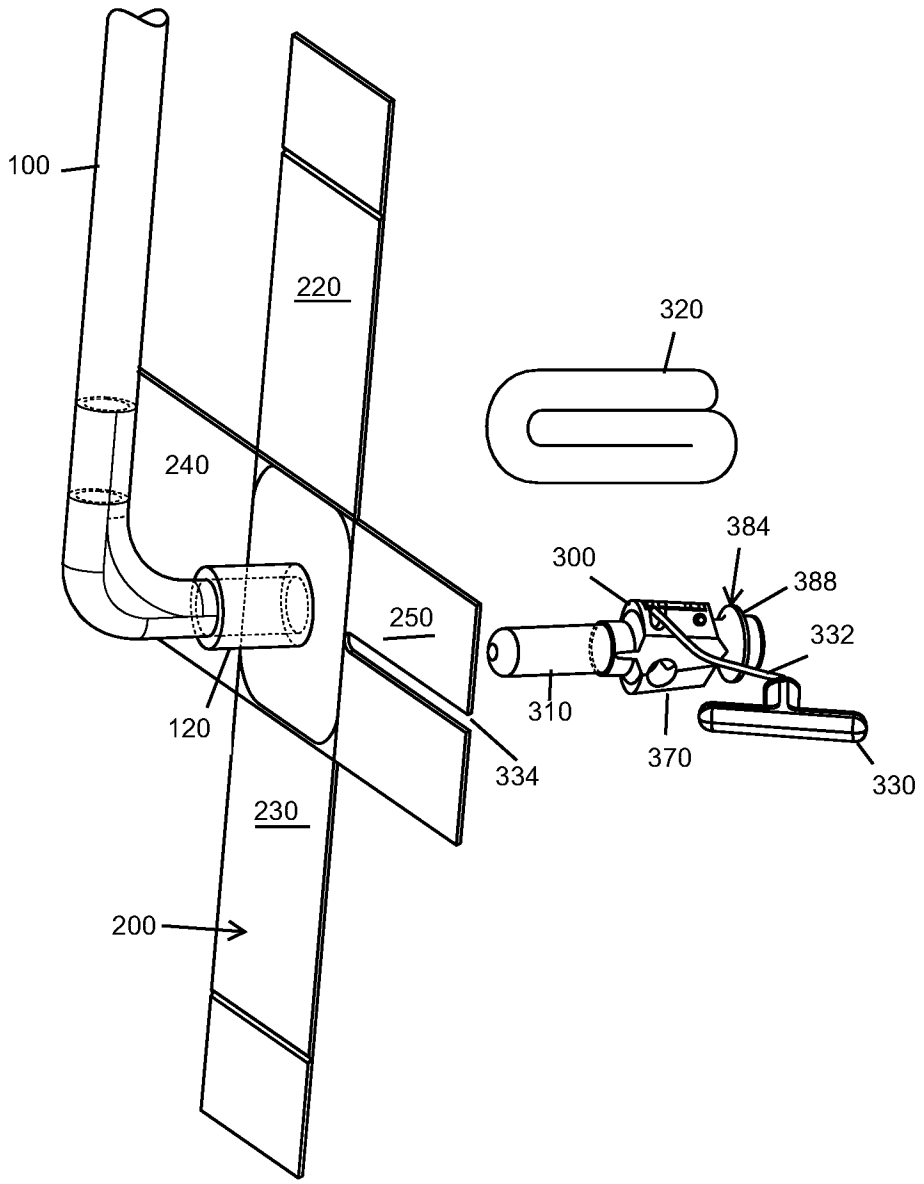
FIG. 2 is a perspective partial exploded view of an example yacht preserver; the view showing the yacht preserver having a handle that connects at its lower end to a collar that has a hollow interior that removably receives a gas canister therein; the view showing the gas canister connected to an inflator device that also connects to an air bladder (which is shown exploded from the inflator device); the view showing an activation device that is a cord extending from the inflator device that is connected to a pull handle that initiates air flow from a gas canister into the air bladder; the view showing a manifold having a flange connected to the housing of the inflator device that is configured to connect to and seal with the air bladder to facilitate the transfer of gas from the gas canister into the air bladder to inflate the air bladder; the view showing the container in an open or a post-deployed state.

In FIGS. 1 and 2, the handle 100 is shown to have a generally L-shaped member having a generally elongated upper section 102 that connects at its lower end to a corner section 104 that connects to lower section 106 that extends approximately perpendicularly to the length of upper section 102. In one arrangement, as is shown, the inward end of lower section 106 connects to collar 120. The L-shape may make it relatively easy for a user to position the container 200 inside the opening 2500. One end of the handle 100 may include a collar 120 which may provide a receiving space for an element of the inflator device, for example, a gas canister 310 of the inflator device 300. In the non-limiting example of FIG. 1, the collar 120 may serve as a connection point to the container 200. For example, the collar 120 may connect to the container 200 by means such as, but not limited to, gluing, welding, adhering, pinning, stitching and/or clipping.

In FIG. 1 the container 200 is illustrated in a closed configuration whereas in FIG. 2 the container 200 is illustrated in an open configuration. As shown in FIG. 2, the container 200 may be comprised of a base plate 210 and a plurality of hinged sidewalls to allow the container 200 to easily open and/or close. For example, the container 200 may have four hinged side walls 220, 230, 240, and 250 connected to the base plate 210. In the non-limiting example of FIG. 2, the hinged sidewalls may be manipulated into the closed configuration of FIG. 1 and held in place by means such as, but not limited to, magnets, adhesives, frangible pins, slip pins, breakable members, tearable members, welding, hook and loop members (such as Velcro®), or any other arrangement. In at least one non-limiting example embodiment, the base plate 210 may have an aperture in line with the collar 120. This aperture may allow an element of the inflator device 300, such as gas canister 310, to extend outside of the container 200 and into the collar 120.

Container 200 may be formed of any suitable size, shape and design and serves to hold and protect the contents within the container 200 until the yacht preserver system 1000 is ready to be used. In one arrangement, container 200 is formed of a relatively rigid, but flexible solid material, such as plastic, cardboard, a combination of plastic and cardboard, or any other composite material. In an alternative arrangement, container 200 is formed of a thin and flexible material, such as a plastic or composite film. In an alternative arrangement, container 200 serves more like a bag. In other arrangements, portions of container 200 are formed of solid materials, such as cardboard, plastic or a combination thereof, whereas other portions of container 200 are formed of a thin and flexible material, such as a plastic film. Any other form of an arrangement is hereby contemplated for use for container 200.

Figure 3:
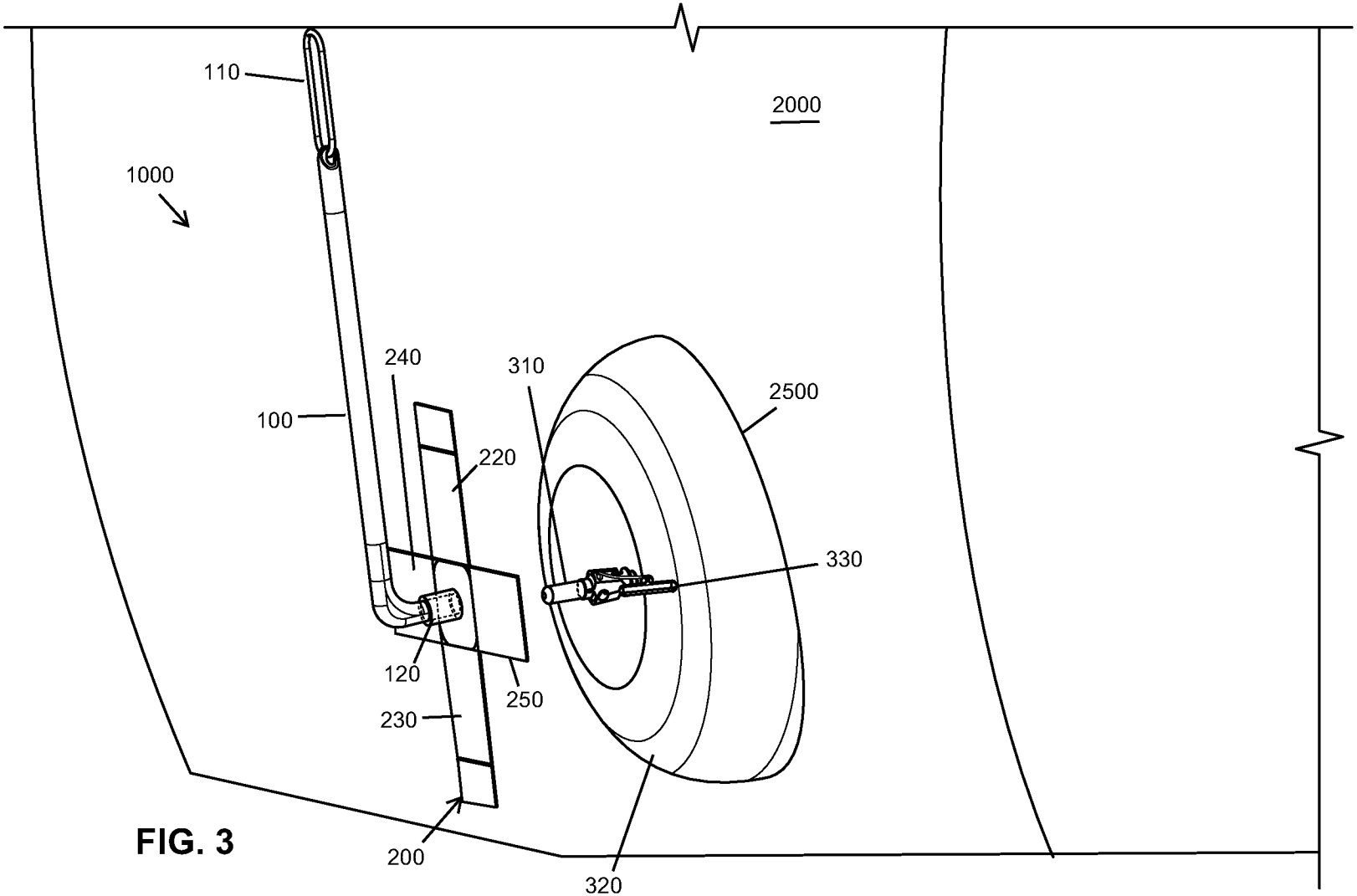
FIG. 3 is a perspective view of the yacht preserver having the air bladder inflated within an opening in a yacht; the view showing the yacht preserver having a handle that connects at its lower end to a collar that has a hollow interior that removably receives a gas canister therein; the view showing the gas canister connected to an inflator device that also connects to an air bladder; the view showing the container in an open or a post-deployed state; the view showing the gas canister removed from the hollow interior of the collar of the handle; the view showing the container in an open or a post-deployed state.

Referring to FIGS. 2 and 3, the inflator device 300 may be comprised of a gas canister 310 and a bladder 320. The gas canister 310 may house compressed gas, for example, compressed carbon dioxide that may fill the bladder 320. The gas canister 310, may be activated by a pull handle 330 so that when the pull handle 330 is pulled, gas rapidly fills the bladder 320 causing the bladder 320 to expand. The container 200, of course, may be configured to accommodate the pull handle 330. In one arrangement, as is shown, a cord 332 extends through a slot 334 in container 200 to facilitate operation of inflator device 300.

For example, as shown in FIG. 2, side wall 250 may include a slot 334 allowing a cord 332 of the pull handle 330 to fit therein so one end of the cord 332 can attach to the inflator device 300 while another end of the cord 332 can attach to the pull handle 330 which may be outside of the container 200. As shown in FIG. 3, the bladder 320 may be configured to expand to a volume sufficient to plug an opening 2500 in a yacht 2000.

It is understood that the embodiments are not limited to the arrangements shown in the figures. For example, rather than having a slotted side wall 250, the base plate 210 may have a hole therein through which the cord 332 of the pull handle 330 may be fed. In one arrangement, the cord 332 may run along a length of the handle 100 towards the lanyard 110 and may be held in place by a clip. Thus, in this latter embodiment, a user may position the container 200 housing the inflator device 300 in or near the opening 2500 of the yacht 2000 with one hand and then use the other hand to pull the pull handle 330 to activate the gas canister 310 to inflate the bladder 320 and plug the hole 2500. Any other form of an activation mechanism is hereby contemplated for use, such as a push button device, a trigger device, a toggle device, a twist activation device, a lever device, or any other form or shape of an activation device that initiates inflation of air bladder 320 and/or gas flow from gas canister 310 into bladder 320.

In at least one non-limiting example embodiment, the gas canister 310, before activation, may be inserted into the container 200, through the aperture in the base plate 210 of the container 200 and into the hollow interior of collar 120 of the handle 100. The collar 120 may be designed to temporarily receive, hold and capture the gas canister 310, while allowing gas canister 310 to be released after inflation of the bladder 320. For example, the gas canister 310 may be coupled to the collar 120 by friction, a magnet, a selectively breakable or weak adhesive, or a frangible member. As such, the gas canister 310 is detachably attached to the handle 100.

In operation the user may position the container 200 holding the inflator device 300 by manipulating the handle 100 so the container 200 holding the inflator device 300 is near or in an opening 2500 at a side of a yacht 2000 as shown in FIG. 1. The user, or a user's assistant may then pull the pull handle 330 to activate the gas canister 310 of the inflator device 300. Gas from the gas canister 310 may cause the bladder 320 to expand thus opening and/or breaking the container 200 as gas flows from the gas canister 310 into the bladder 320 thereby causing the bladder 320 to expand, as shown in FIG. 3, and sealing the opening 2500. Because the gas canister 310 is detachably held within the opening in collar 120 of handle 100 the handle 100 may then be pulled away leaving the bladder 320 sealing the opening 2500 of the yacht 2000 in place. In this arrangement, after the bladder 320 is inflated, inflator device 300 and the gas canister 310 remain attached to the outward end of the inflated bladder 320.

Figure 4:
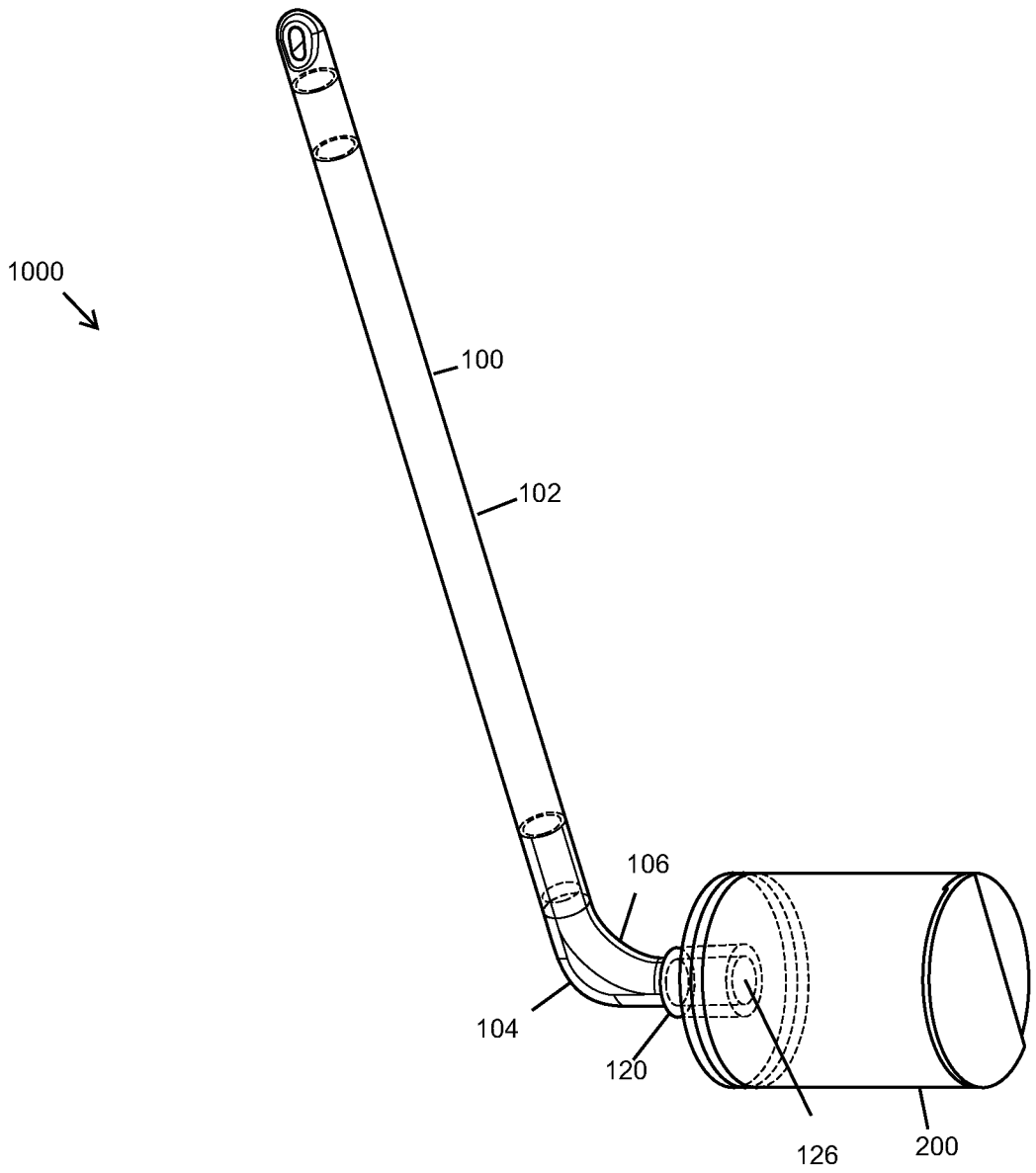
FIG. 4 is perspective view of another embodiment of a yacht preserver, the view showing the yacht preserve in a pre-deployed state; the view showing the container of the yacht preserver having a generally cylindrical shape.

It is understood the embodiments are not limited the above described examples. Rather, it is contemplated that one or more embodiments may utilize various alternative configurations. For example, FIG. 4 illustrates another example of a yacht preserver system 1000. The yacht preserver system 1000, like the yacht preserver system 1000, includes a handle 100 and a container 200 housing an inflator device which may be substantially similar or identical to the inflator device 300. However, instead of having a container 200 with hinged walls like that of yacht preserver system 1000, yacht preserver system 1000 has a cylindrical container 200 having one end attached to the handle 100 and another end through which a bladder 320 may exit. Like bladder 320, bladder 320 may seal off an opening 2500 that may be present in a side of a yacht.

Figure 5:
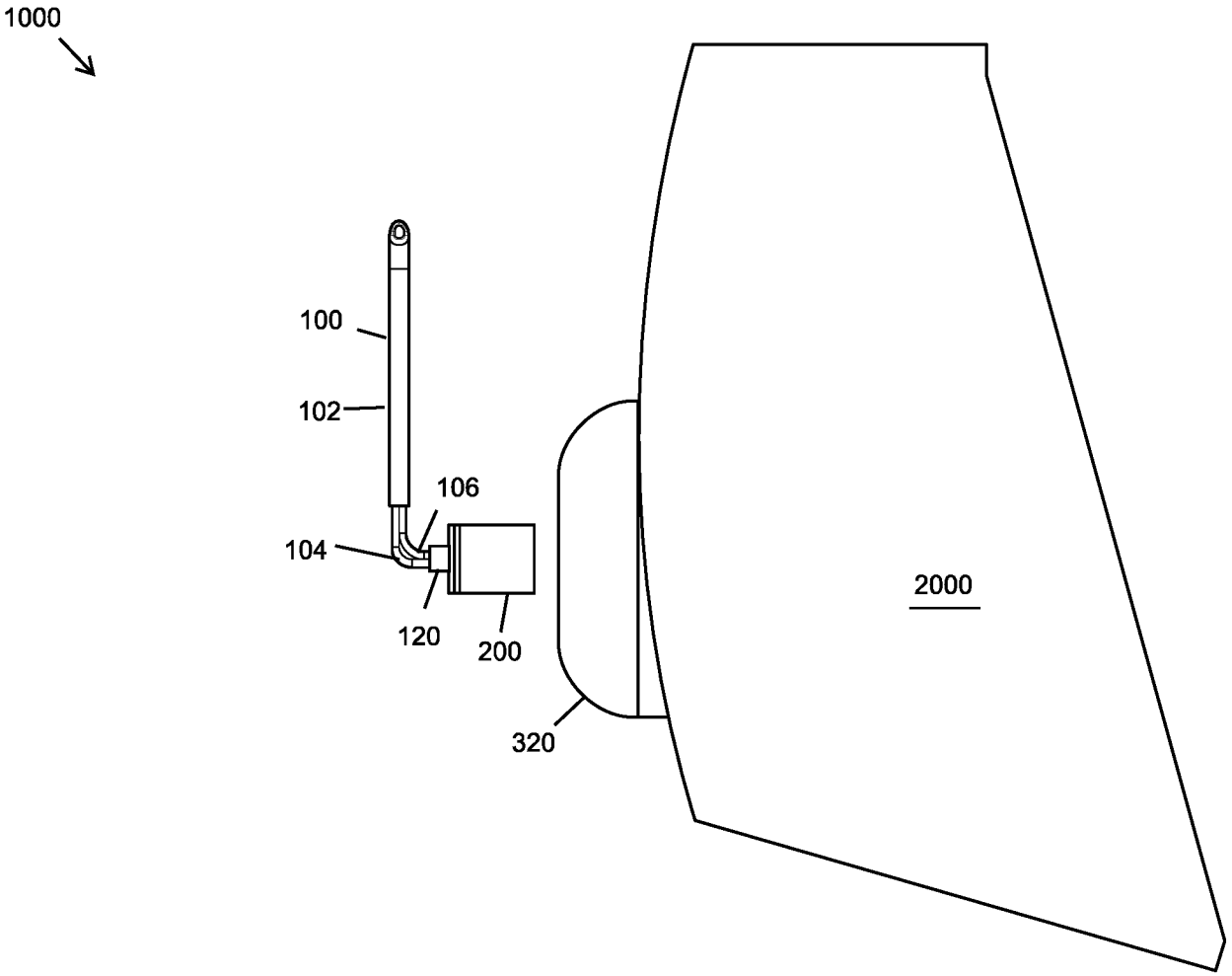
FIG. 5 is a side elevation view of the pre-deployed yacht preserver shown in FIG. 4, the view showing the yacht preserver near an opening in a side of a yacht; the view also showing a deployed bladder inflated within an opening in a yacht.
Figure 7:
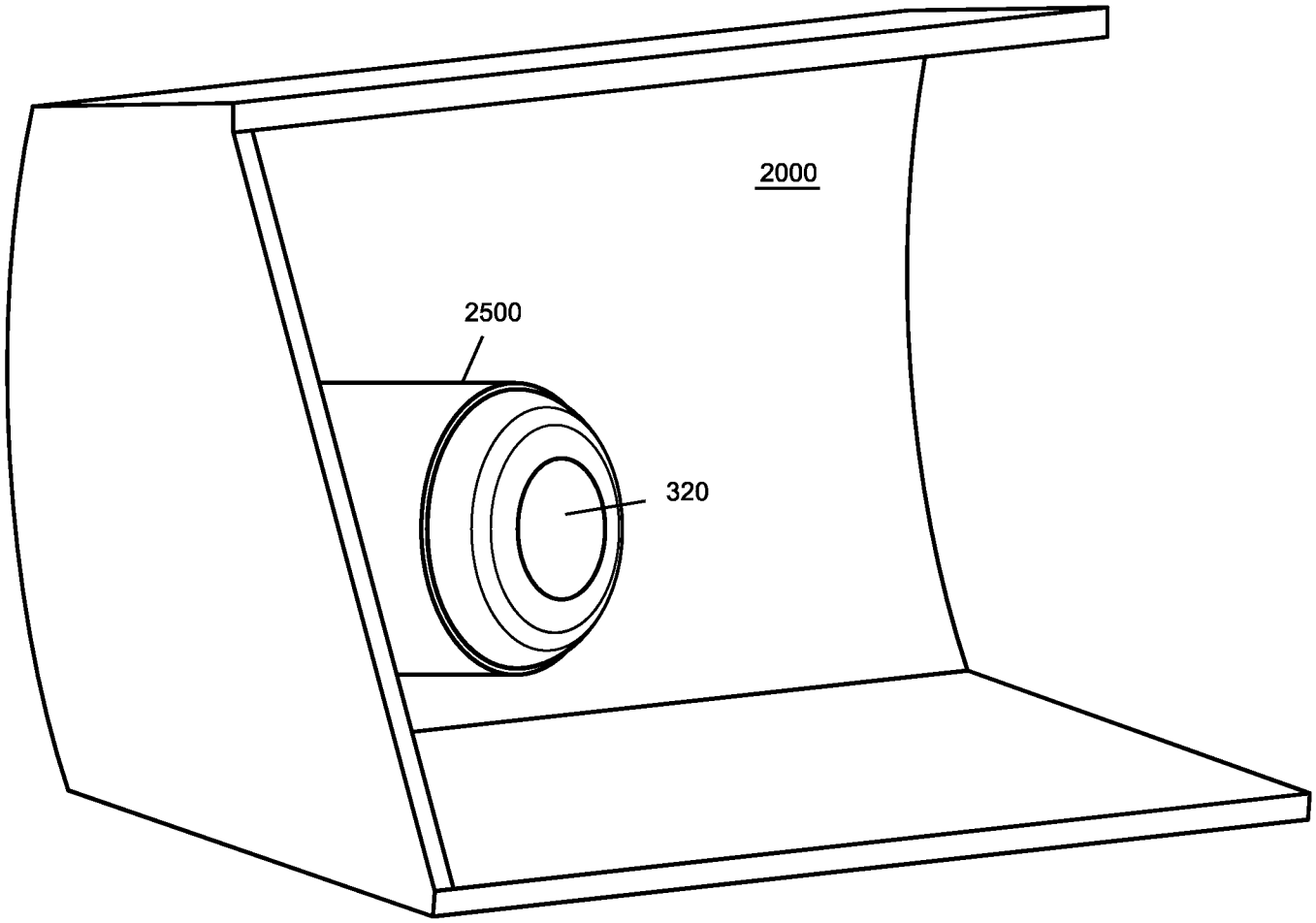
FIG. 7 is a perspective back view of the inside of a transom of a yacht, the view showing an air bladder of a yacht preserver inflated within an opening of the yacht.

FIG. 5 is a side view showing a yacht 2000 with the bladder 320 of the yacht preserver system 1000 deployed. As shown in FIG. 5, the bladder 320 of yacht preserver system 1000 seals off an opening of the yacht 2000. As shown in FIG. 7, the bladder 320 may extend along a length of the opening to create a relatively tight water seal. It is understood the bladder 320 may also extend along a length of an opening as well.

In operation a user may position the container 200 holding the inflator device 300 by manipulating the handle 100 so the container 200 holding the inflator device 300 is near or in an opening 2500 at a side of a yacht 2000. The user, or a user's assistant may then pull the pull a handle or other activation device to activate the canister of the inflator device 300. Gas from the gas canister 310 may cause the bladder 320 to expand thus opening an end of the container 200 through which the bladder 320 is deployed, thereby sealing the opening 2500. As with yacht preserver system 1000, the canister of yacht preserver's 1000's inflator device may be detachably attached to the handle 100. Because the gas canister is detachably attached to the handle 100 the handle 100 may then be pulled away leaving the bladder 320 sealing the opening 2500 of the yacht 2000 in place. One benefit of the system is that it is self-reinforcing. That is, once inserted and inflated the pressure of the water from outside the vessel applies a pressure forcing the yacht preserver system 1000 into the vessel. This pressure helps to seal the yacht preserver system 1000 into the vessel. In one arrangement, the yacht preserver system 1000 increases in dimensional size from one end to the other, such as being in a slight cone shape with its wider end being positioned at its outward end. In another arrangement, the yacht preserver system 1000 includes a ring or flange at its outward end that is larger than the opening 2500 and therefore seals against the outside edge of the opening 2500 as the remaining portions of the yacht preserver system 1000 are inside of the opening 2500. As the pressure of the water pushes on the yacht preserver system 1000, this area of greater size is forced to create a strong seal with the yacht 2000. This seal is self-reinforcing as the greater the pressure of the water the stronger the seal. Also, the greater the water pressure on the yacht preserver system 1000, and/or bladder 320, the less likely it is that the yacht preserver system 1000 will become unintentionally dislodged.

In one arrangement, gas canister 310 is known as a "Powerlet" cartridge, or commonly referred to as a CO2 charger, or similar terminology, and is a small disposable metal container holding 8-12 grams (0.28-0.42 oz.) of compressed CO2 and often a small quantity of oil. These gas canisters 310 are commonly used as a power source for certain air guns, airsoft guns, paintball guns, life vests, and for quick inflation of various devices. In an alternative arrangement, larger sized gas canisters 310 are used so as to fill larger sized bladders 320. Standard sized gas canisters come in 16 gram, 18 gram, 25 gram, 38 gram and XLA 40 gram, among other sizes, all of which are contemplated for use. In an alternative arrangement, multiple gas canisters 310 are used in association with inflator device 300.

In an alternative arrangement, with reference to FIGS. 14-18, an alternative arrangement is presented. Many large yacht's 2000 have on-board air pressure systems 400, such as a conventional air compressor having a motor and a tank that provides a source of pressurized air. Many times, large maintenance projects that require plugging an opening 2500 in the side of yacht 2000, such as the removal of an engine, are known well in advance. In these situations, it is possible to utilize the air pressure system 400 to inflate yacht preserver system 1000. Or, alternatively, these maintenance projects are performed at a marina or dock where an air pressure system 400, such as an air compressor, can be secured and used. The utilization of an air pressure system 400 provides the benefits of having a robust pressurized air source with an essentially unending supply of pressurized air to inflate bladder 320. This arrangement ensures that the inevitable leakage of air that occurs over time from the bladder 320, albeit small and slow, is sufficiently replaced such that the optimum pressure within the bladder 320 is maintained and thereby prevents the strength of the seal between bladder 320 and opening 2500 from diminishing over time. This is desirable in situations where the opening 2500 in yacht 2000 needs to be sealed for a long period of time, such as when an engine is replaced.

As one example, with reference to FIGS. 14-18, air pressure system 400 is presented which is part of yacht 2000. A hose 410 fluidly connects air pressure system 400 to shut off valve 420. Shut off valve 420 includes a handle 430 that facilitates manual control of shut off valve 420. Shut off valve 420 connects to bladder 320.

Air pressure system 400, is any source of pressurized air, such as a conventional air compressor having a motor and a tank, or alternatively a portable air tank that is pressurized, or a hand pump (similar to what is used to inflate bicycle tires). Air pressure system 400 may be an on-board system that is permanently attached to yacht 2000. Alternatively, air pressure system 400 may be a portable unit that is placed on board yacht 2000, on a dock, in a marina or an adjacent boat or yacht. In yet another alternative arrangement, air pressure system 400 may be separate from yacht 2000 and instead may be associated with a dock, marina or other facility that is performing the maintenance that requires sealing of opening 2500 in yacht 2000.

Hose 410 is any device that fluidly connects air pressure system 400 to shut off valve 420 and/or bladder 320 and thereby provides a source of pressurized air to bladder 320. In the arrangement shown, hose 410 is a conventional air hose, however any other air conduit is hereby contemplated for use.

Shut off valve 420 is any valve device that controls the entry and/or exit of air into bladder 320. In one arrangement shut off valve 420 facilitates the entry and exit of air into bladder 320, in this arrangement shut off valve 420 only opens and closes the air passage way into bladder 320. In an alternative arrangement, shut off valve 420 is a check valve that includes a mechanism, such as a flexible membrane or seal or the like, that facilitates air flow into bladder 320 but prevents air flow out of bladder 320. In yet another arrangement, shut off valve 420 includes a venting setting that when handle 430 is rotated to the venting position, air is vented and the bladder 320 is deflated. In one arrangement, shut off valve 420 includes a regulator device that regulates the air pressure within the bladder 320. In one arrangement, regulator device sets the upper limit on the pressure within bladder 320 and when the pressure within bladder 320 exceeds the predetermined threshold, the shut off valve allows venting of the excess pressure until the pressure falls below the predetermined maximum allowable pressure thereby preventing over inflation or explosion of bladder 320.

In one arrangement, shut off valve 420 includes handle 430 that facilitates manual manipulation of shut off valve 420. In this arrangement, shut off valve 420 may be moved between an open position, a closed position and/or a venting position by operation of handle 430. In other arrangements, without handle 430, the state of shut off valve 420 is controlled by other manners or means such as connection to or disconnection from hose 410, or the like. In another arrangement, wherein shut off valve 420 is a one-way-valve or a check valve that only allows air to flow into bladder 320 a separate venting mechanism is positioned on bladder 320 that facilitates venting of the pressurized air within bladder 320 when deflation is needed. This venting member may be an opening covered by a threaded cap or the like. In another arrangement, no venting member may be present and in this arrangement, once inflated, the yacht preserver system 1000 must be destroyed, such as punctured, to deflate the bladder 320.

In one arrangement, hose 410 connects to shut off valve 420 by a connecting mechanism, such as what is commonly known as an air hose quick-connect system. This arrangement facilitates quick and easy connection to and disconnection from shut off valve 420. These air hose quick-connect systems are common place on many air compressors and therefore the use of this a quick connect may facilitate quicker and easier operation of the yacht preserver system 1000. However, any other connection mechanism or system is hereby contemplated for use.

Figure 17:
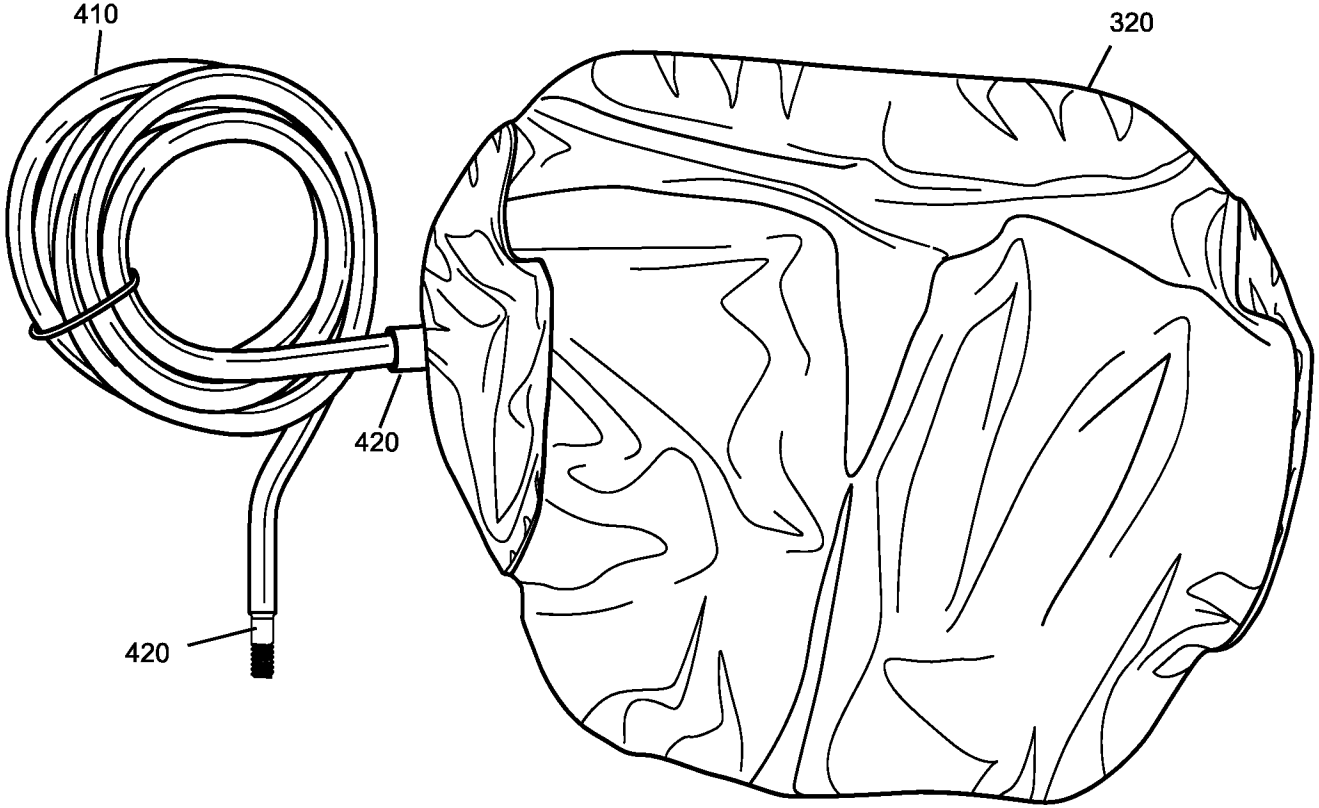
FIG. 17 is an elevation view of a yacht preserver system; the view showing the air bladder in a deflated state; the view showing a hose connected to the air bladder; the view showing a valve connected to the end of the hose to facilitate connection to a hand air pump and/or a motorized air pressure system.

In another arrangement, bladder 320 includes a valve 420 connected directly to bladder 320 or to a length of hose 410. In one arrangement, as is shown in FIG. 17, this valve 420 is what is known as a Schrader valve, or auto/car valve, that is present on many bicycle and automobile tires. However, any other form of a valve 420 is hereby contemplated for use such as a Dunlop valve, a Presta valve, a Regina valve or any other form of a valve. Multiple valves may be present on yacht preserver system 1000. As one example, a valve 420 may be present at the end of hose 410 and a second valve 420 may be present at the intersection of hose 420 and bladder 320.

In operation, when scheduled maintenance is about to begin that will leave opening 2500 in yacht 2000 open or other circumstance requiring sealing of opening 2500 in yacht 2000 occur, a user connects air pressure system 400 to yacht preserver system 1000 and inflates the bladder 320.

Figure 14:
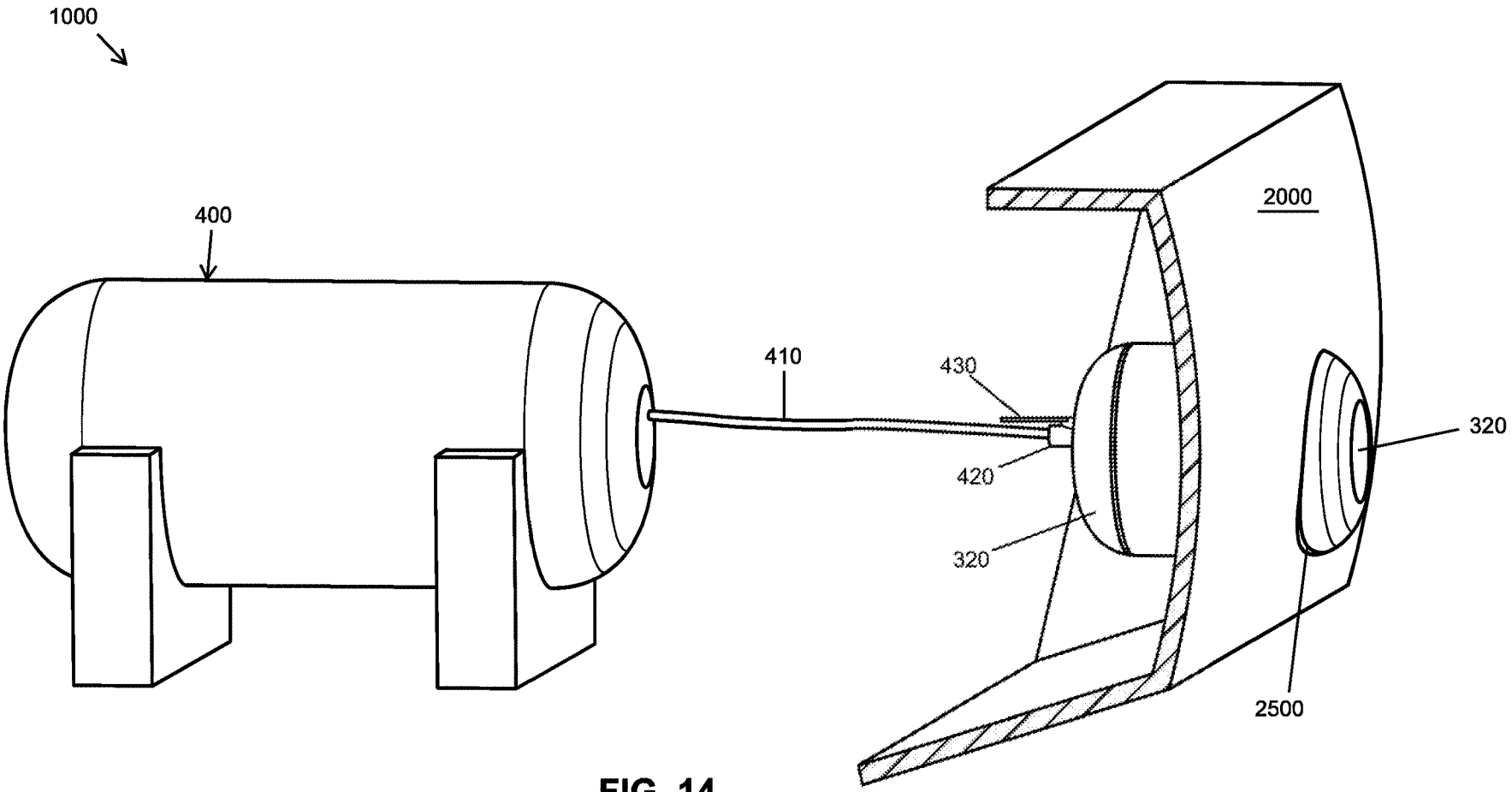
FIG. 14 is a perspective view of another embodiment of a yacht preserver system; the view showing an air pressure system connected to the air bladder by a hose; the view showing a valve having a handle connected to the air bladder and the hose; The view showing the air bladder inflated from inside the yacht.
Figure 15:
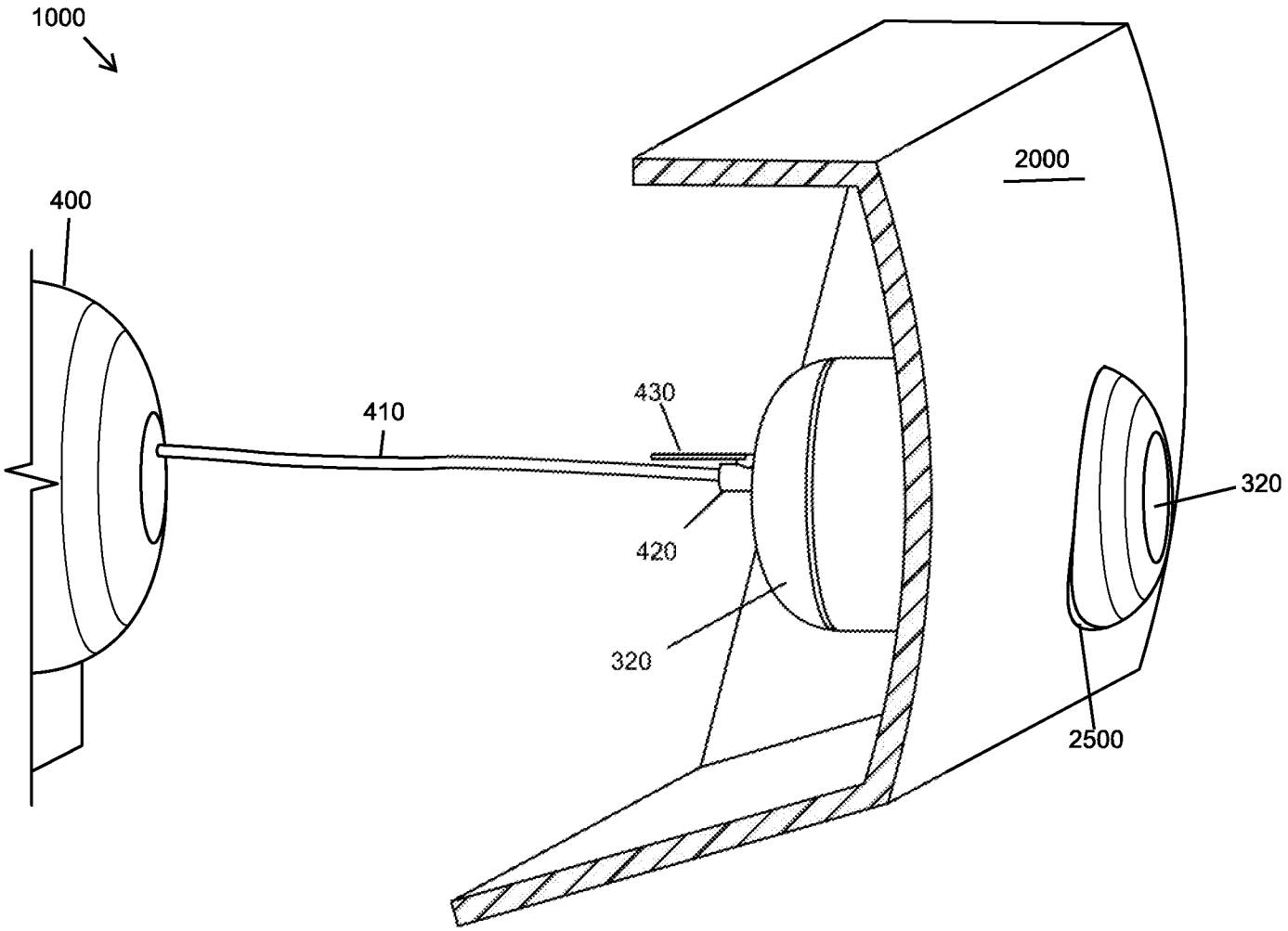
FIG. 15 is a close up perspective view of the yacht preserver system of FIG. 14.
Figure 16:
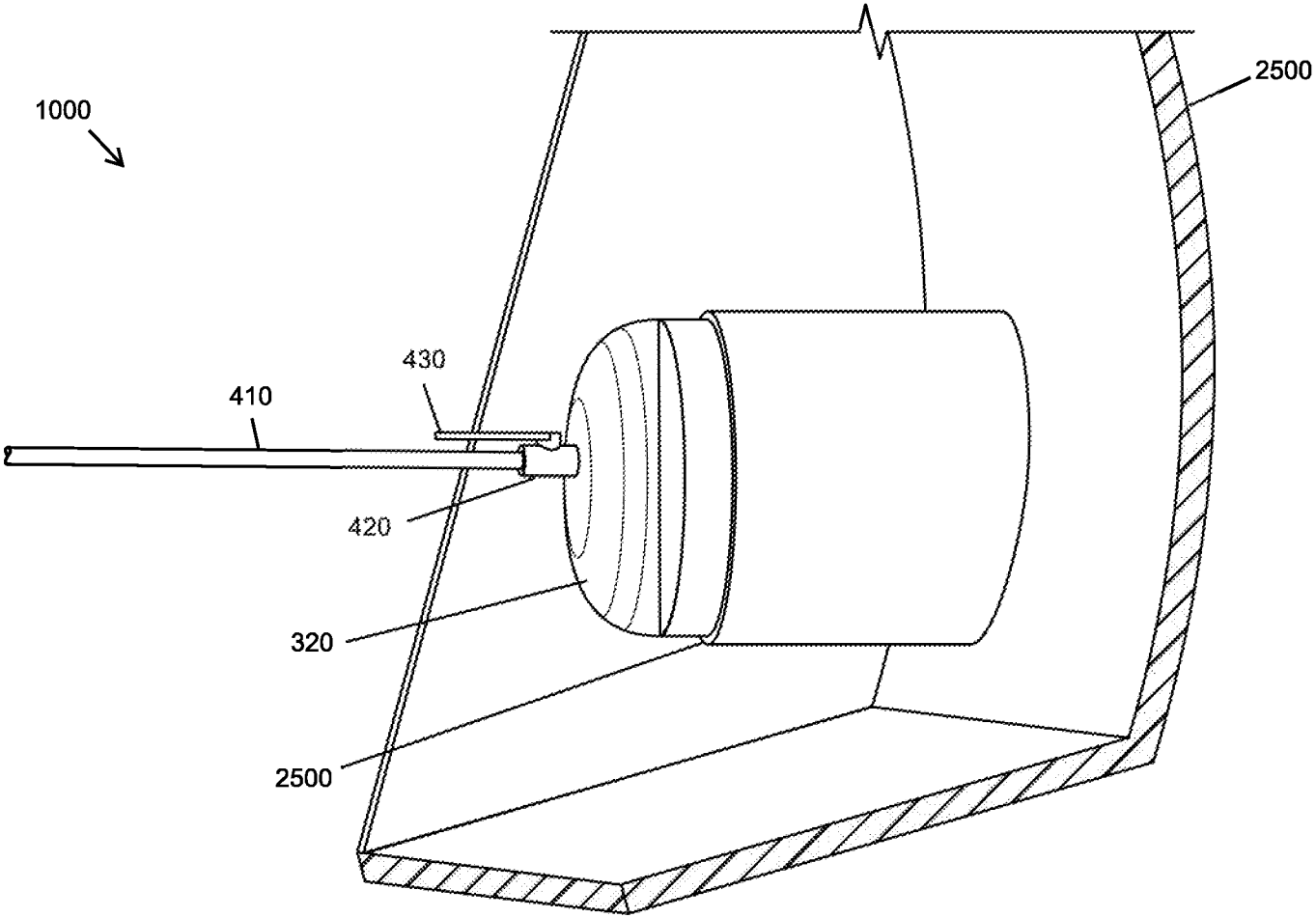
FIG. 16 is another close up perspective view of the yacht preserver system of FIG. 14.
Figure 18:
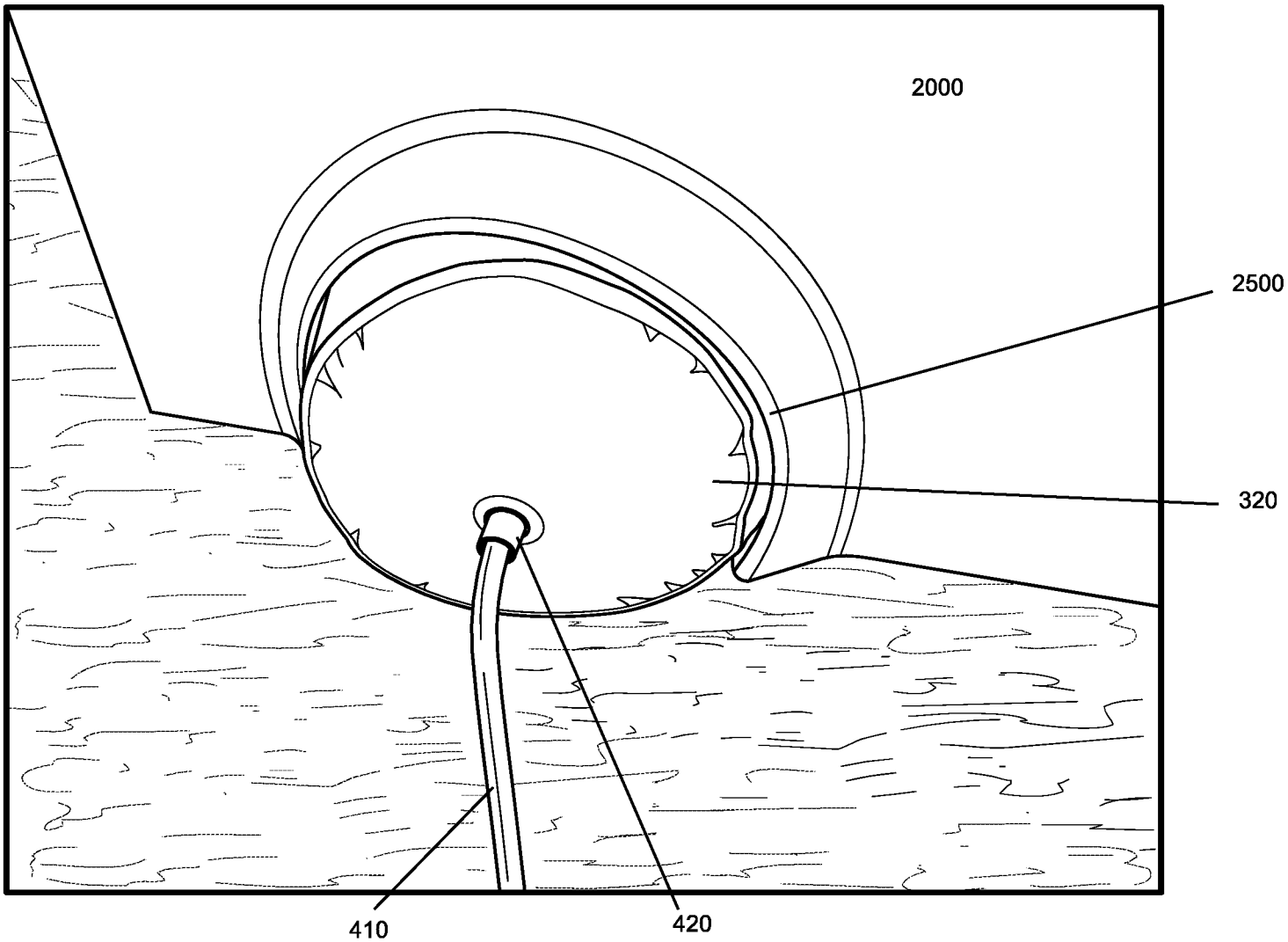
FIG. 18 is a perspective view of a yacht preserver system installed into an opening of a yacht from outside the yacht; the view showing a hose connected to the air bladder which is connected out-of-view to a hand air pump and/or a motorized air pressure system or other source of pressurized air.
Figure 19:
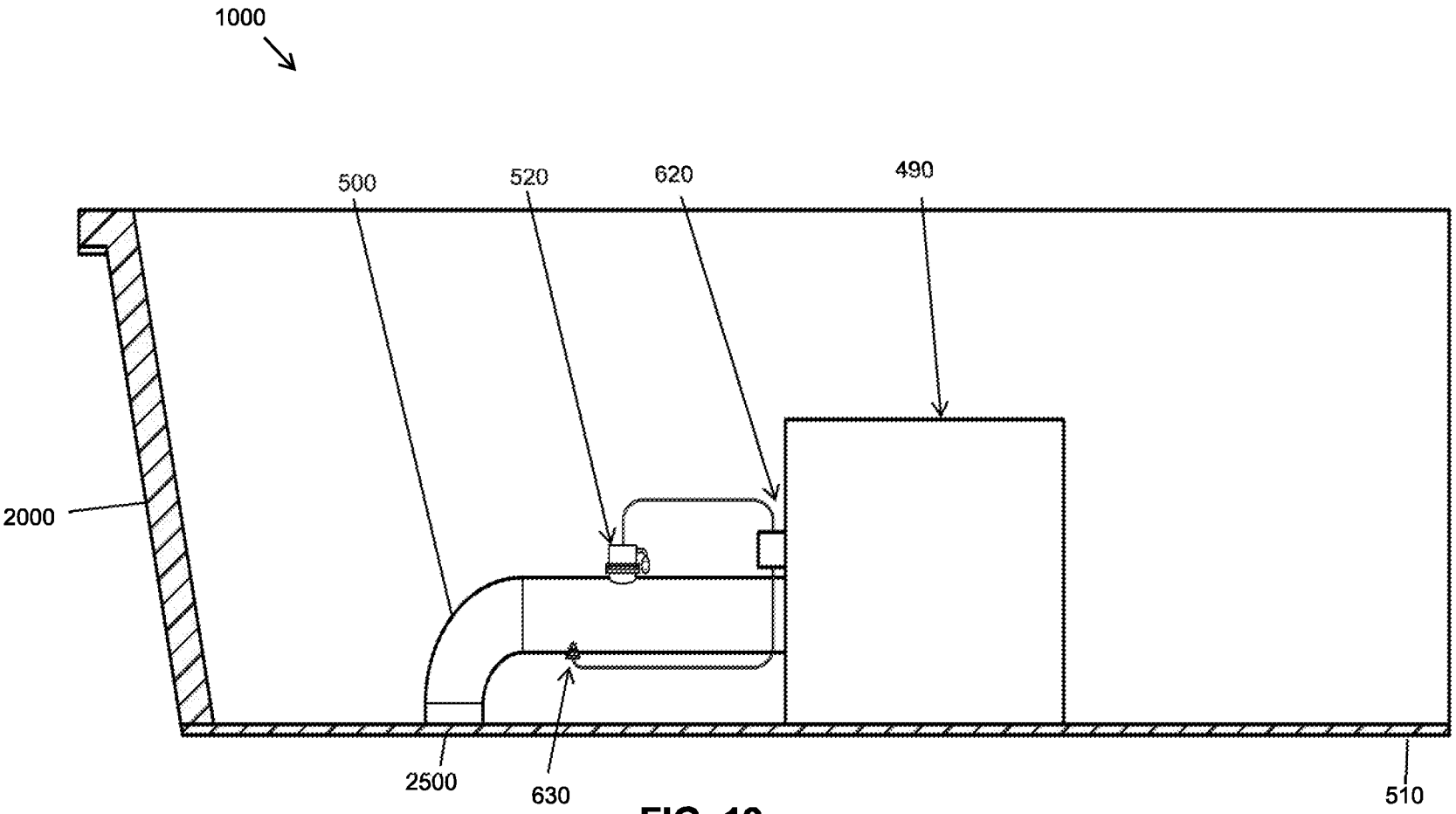
FIG. 19 is an elevation view of another embodiment of a yacht preserver system; the view showing the yacht preserver system installed on an exhaust tube of the yacht; the view showing the yacht preserver system having a container that has a hollow interior that holds an air bladder and is connected to a source of pressurized air; a control mechanism and controller are connected to the yacht preserve system that facilitates operation of the yacht preserver system; the view showing the container sealed by a breakable sealing member that breaks upon deployment of the air bladder.
Figure 20:
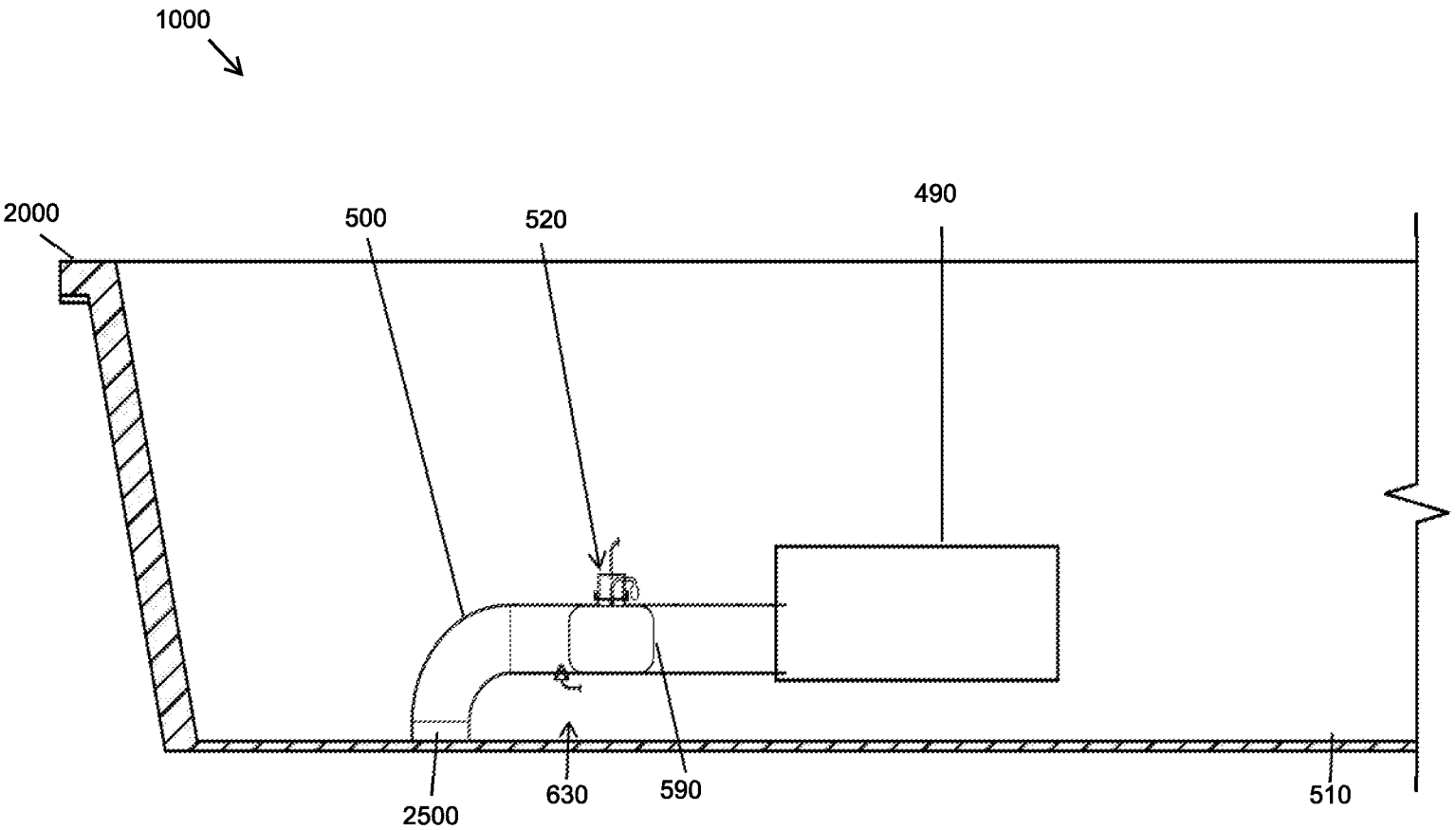
FIG. 20 is an elevation view of the permanently installed yacht preserver system of FIG. 19, the view showing the air bladder in a deployed state and sealing the entirety of the exhaust tube.
Figure 21:
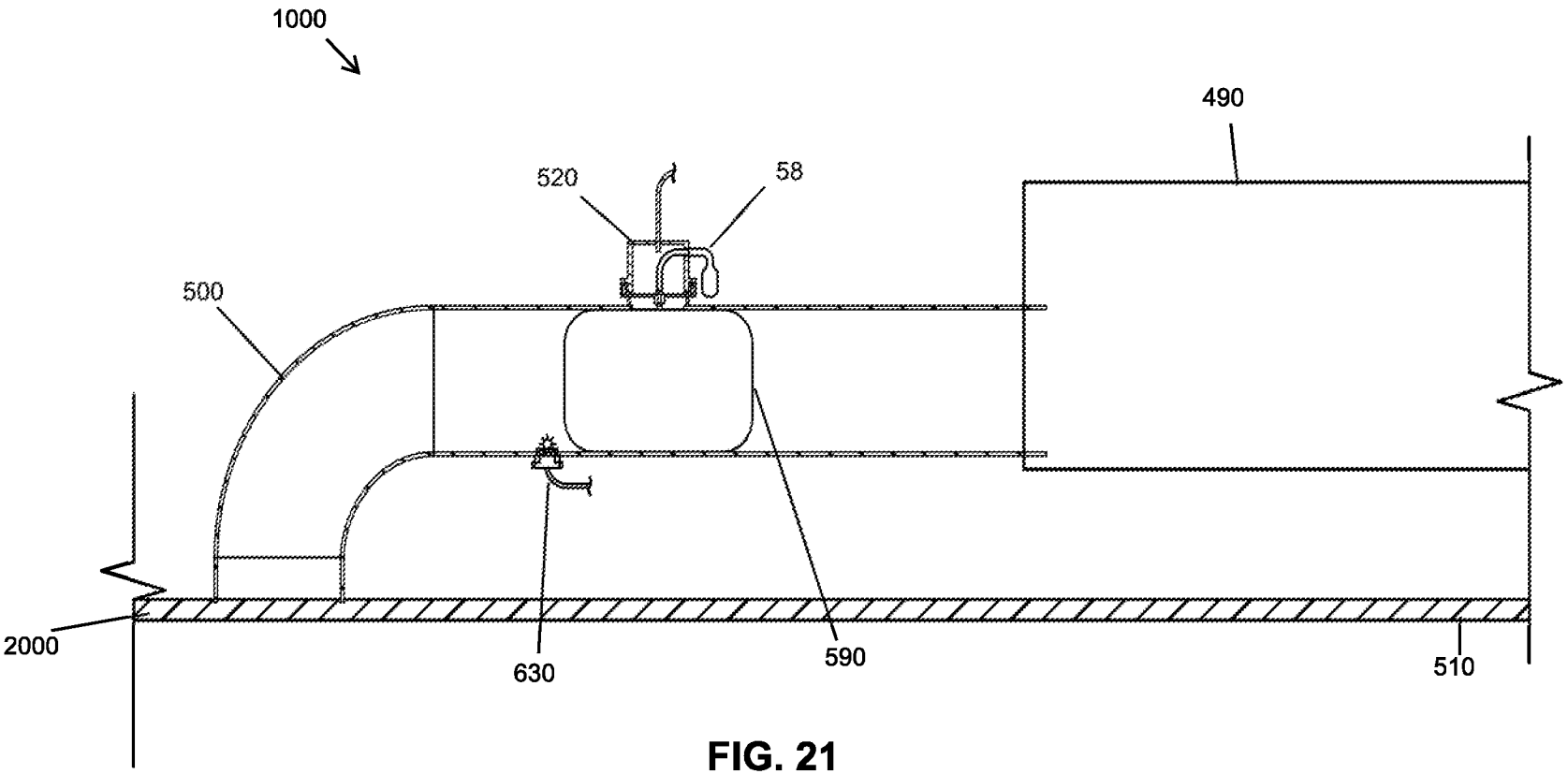
FIG. 21 is a close up elevation view of FIG. 20.
Figure 22:
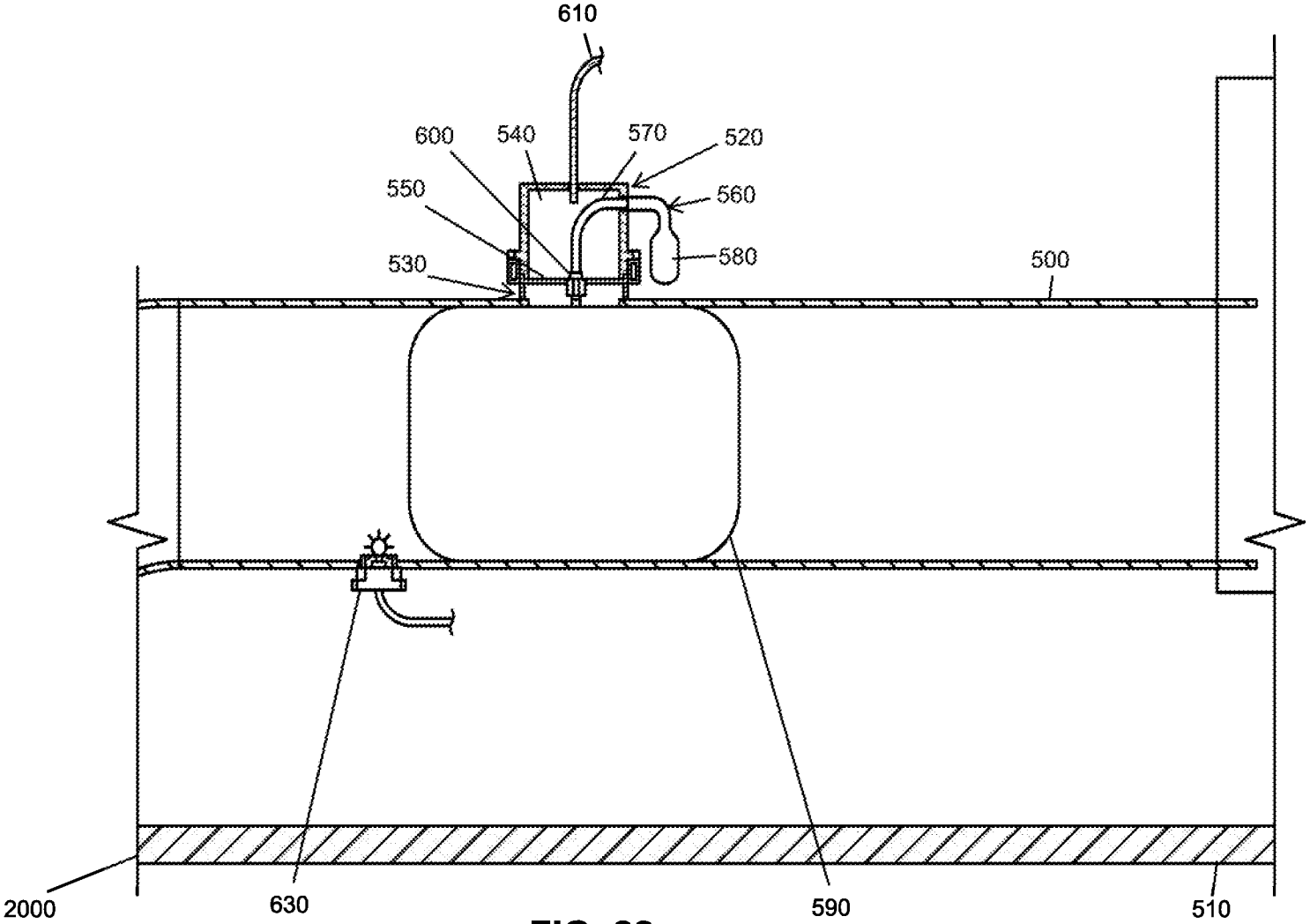
FIG. 22 is a close up elevation view of FIG. 21.
Figure 23:
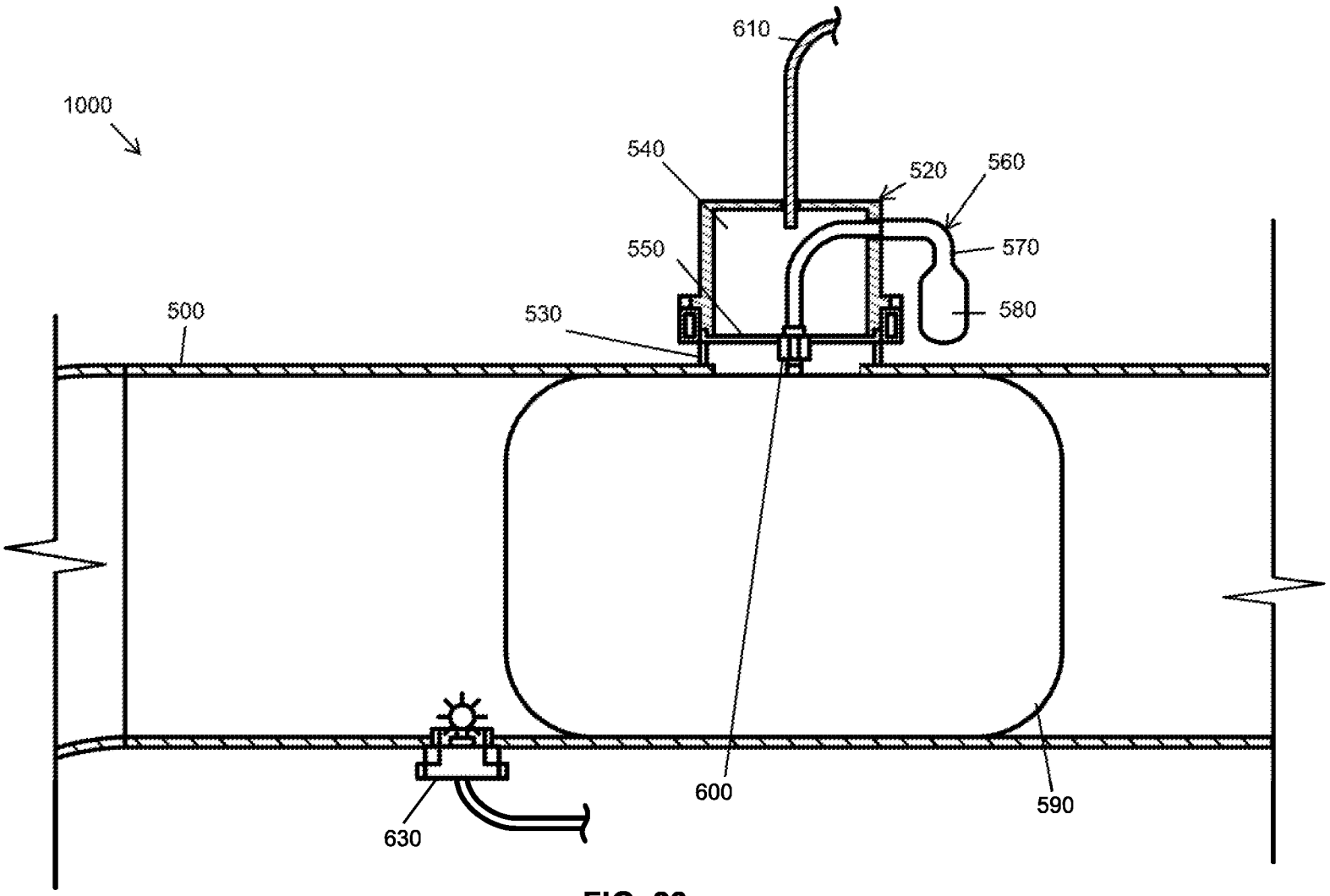
FIG. 23 is a close up elevation view of FIG. 22.
Figure 24:
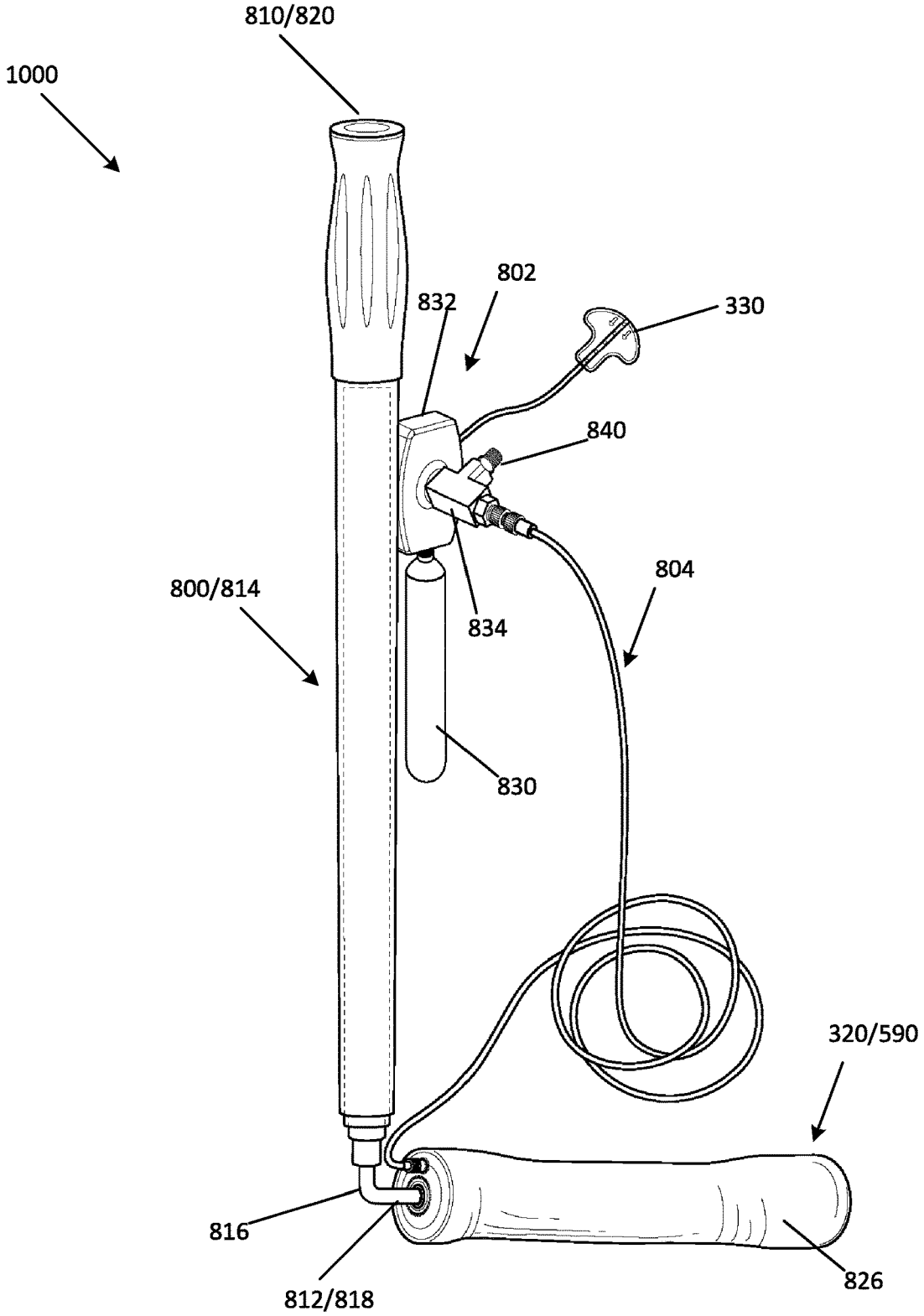
FIG. 24 is a side view of an example yacht preserver, in accordance with one or more arrangements; the view showing the yacht preserver having a handle that having an inflatable bladder connected to a lower end of the handle and having an inflator device connected to an upper end of the handle; the view showing the inflatable bladder in a deflated stored state; the view showing the handle in a retracted state.
Figure 25:
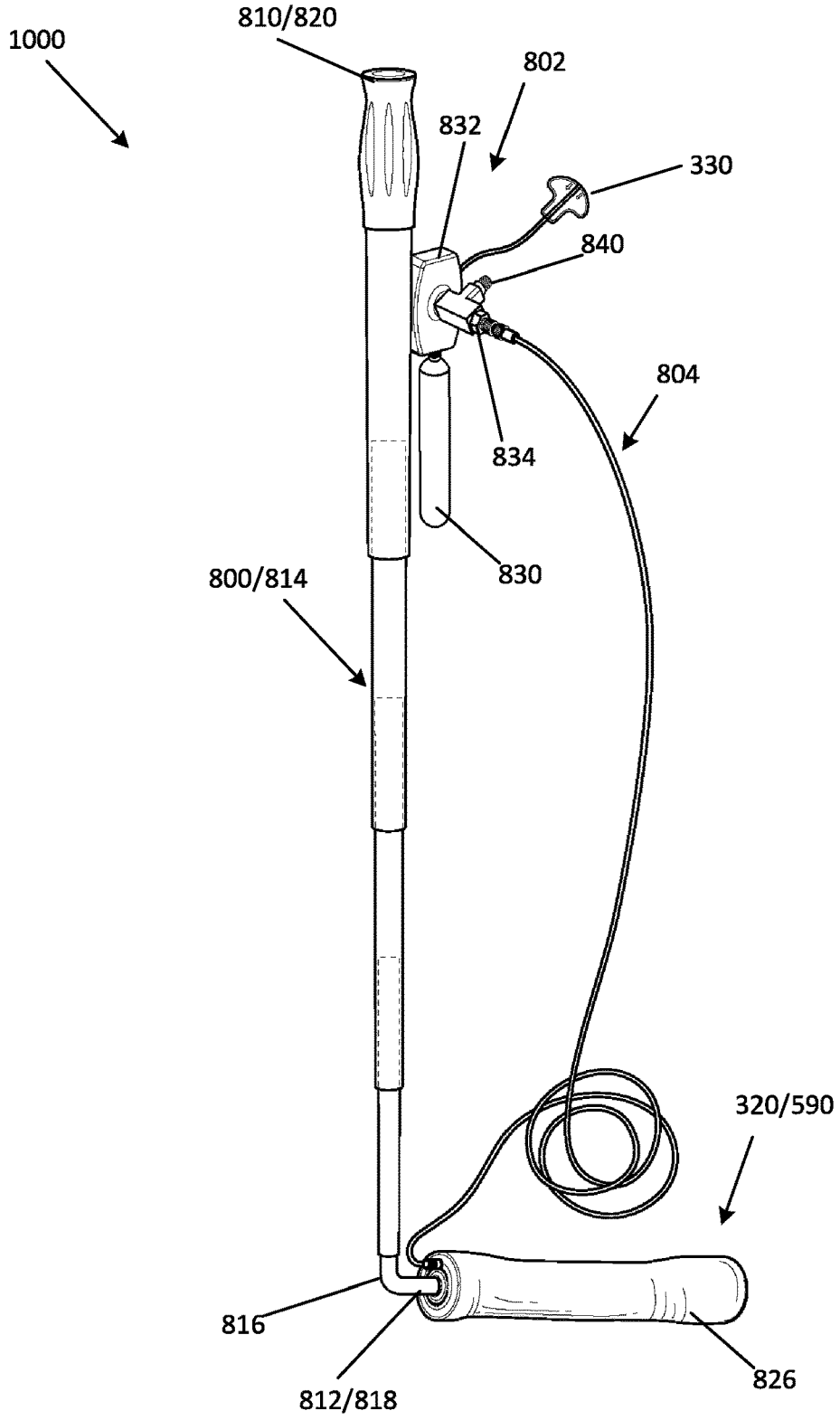
FIG. 25 is a side view of an example yacht preserver shown in FIG. 24, in accordance with one or more arrangements; the view showing the handle expanded to an extended length.
Figure 26:
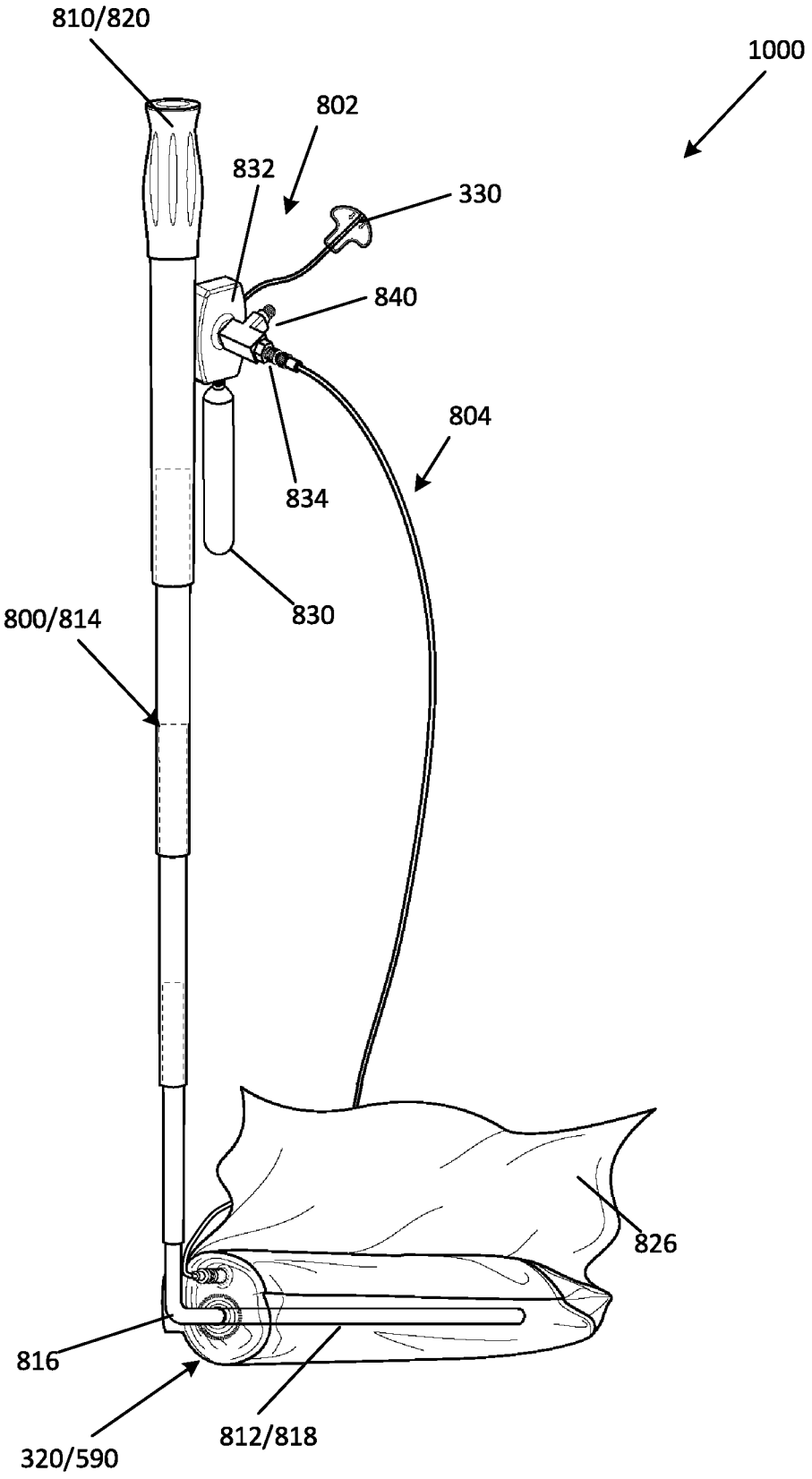
FIG. 26 is a side view of an example yacht preserver shown in FIG. 24, in accordance with one or more arrangements; the view showing the inflatable bladder in the process of expanding.
Figure 27:
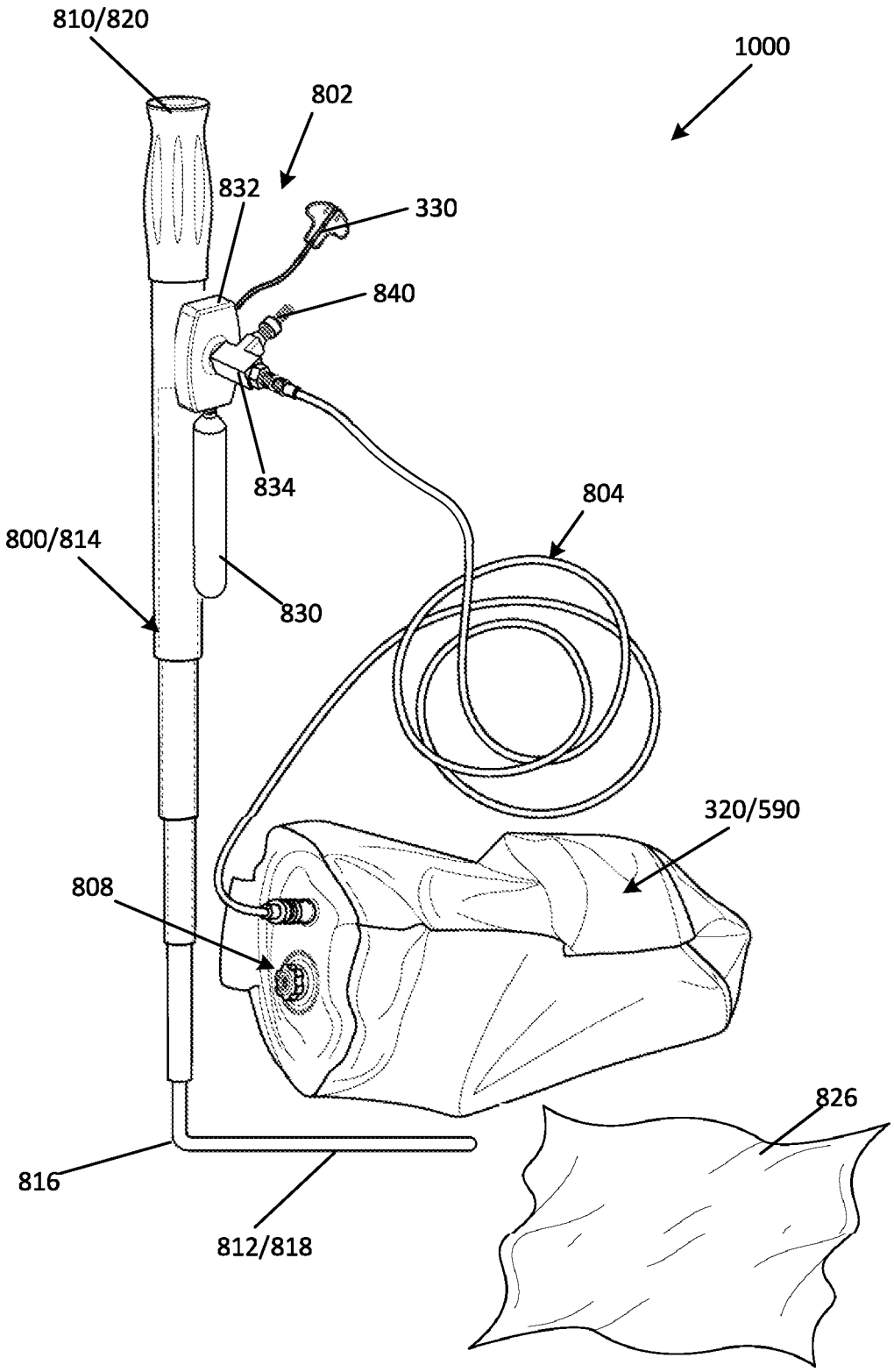
FIG. 27 is a side view of an example yacht preserver shown in FIG. 24, in accordance with one or more arrangements; the view showing the handle detached from the inflatable bladder.
Figure 28:
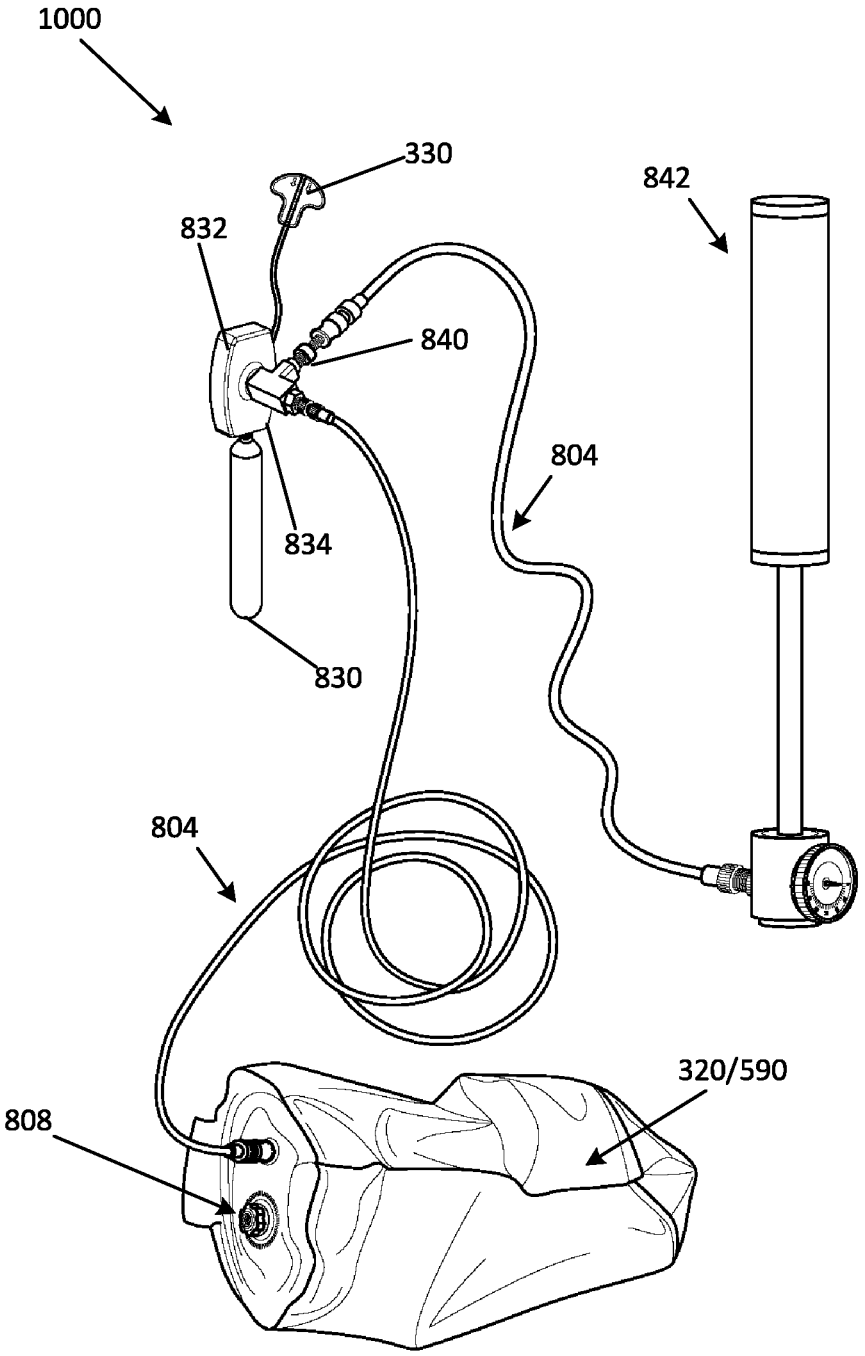
FIG. 28 is a side view of an example yacht preserver shown in FIG. 24, in accordance with one or more arrangements; the view showing the handle detached from the inflator device and the inflatable bladder; the view showing an air pump connected to a Schrader valve of the inflatable bladder; the view showing the inflatable bladder with a safety pressure release valve.
Figure 29:
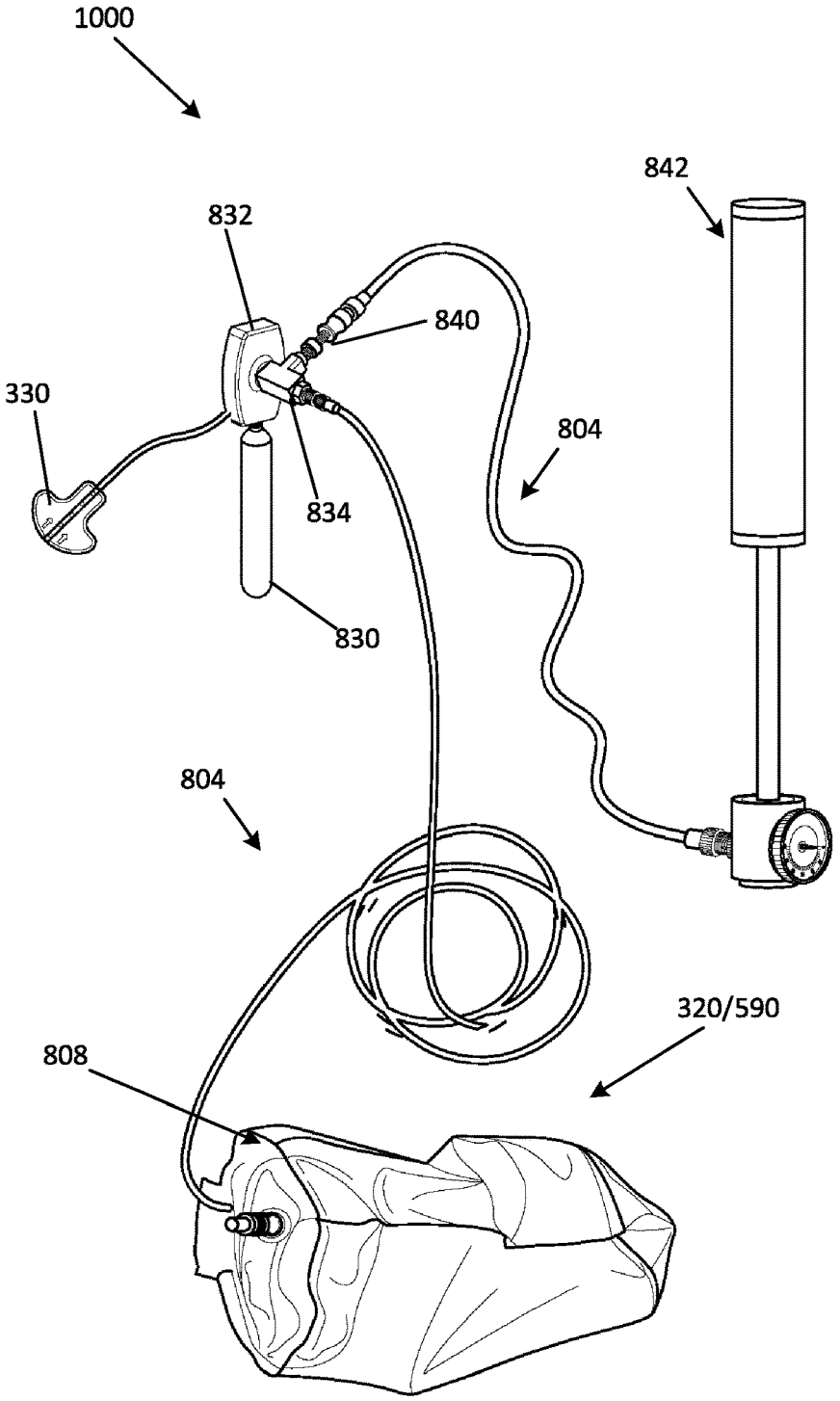
FIG. 29 is a side view of an example yacht preserver shown in FIG. 24, in accordance with one or more arrangements; the view showing the handle detached from the inflator device and the inflatable bladder; the view showing an air pump connected to a Schrader valve of the inflatable bladder; the view showing the inflatable bladder without a safety pressure release valve.

More specifically, in one arrangement, the user connects air hose 410 and valve 420 to air pressure system 400. Next, the user places the bladder 320 into opening 2500. The bladder 320 can be installed either from the inside of the yacht 2000 as is shown in FIGS. 14-16, or, as is shown in FIG. 18, from the outside of the yacht 2000.

Once bladder 320 is installed within opening, the bladder 320 is filled with air. This may be accomplished by rotating handle 430 to open shut off valve 420 thereby allowing air to flow into bladder 320. In another arrangement, the air pressure system 400 is activated thereby supplying air to fill bladder 320.

In the arrangement where shut off valve 420 is a check valve, or a one way valve, the check valve allows air to enter the bladder 320 but prevents it from exiting the bladder 320 such that even if the hose 410 or air pressure system 400 is disconnected the bladder 320 will remain inflated. In this arrangement, to further ensure that bladder 320 remains inflated when disconnected, a cap can be placed at the end of hose 410 and/or valve 420, such as a bicycle stem cap, that will prevent air from leaking through the valve 420. In the arrangement wherein shut off valve 420 includes a regulator, the regulator prevents over inflation of bladder 320 either by venting excess pressure or preventing or metering the pressure that is allowed to enter the bladder 320.

While in use, when the bladder 320 remains connected to air hose 410 and air pressure system 400, over time, as air inevitably leaks out of bladder 320 the air is continuously replenished by the connection to the air hose 410 and air pressure system 400. This prevents the bladder 320 from coming dislodged over time due to air leakage.

To remove the bladder 320 from opening 2500, in one arrangement, the air hose 410 or air pressure system 400 is dislodged from the shut off valve 420 thereby allowing the air to deflate from the bladder 320. In another arrangement, bladder 320 is deflated by opening a deflation device in the bladder 320, such as a cap or plug or the like. In another arrangement, bladder 320 is deflated by rotating handle 430 to a venting position thereby venting air out of bladder 320. In another arrangement, bladder 320 is destructively deflated by puncturing bladder 320.

Once deflated, yacht preserver system 1000 can be stored for use at a later time in the same manner described herein.

Figure 6:
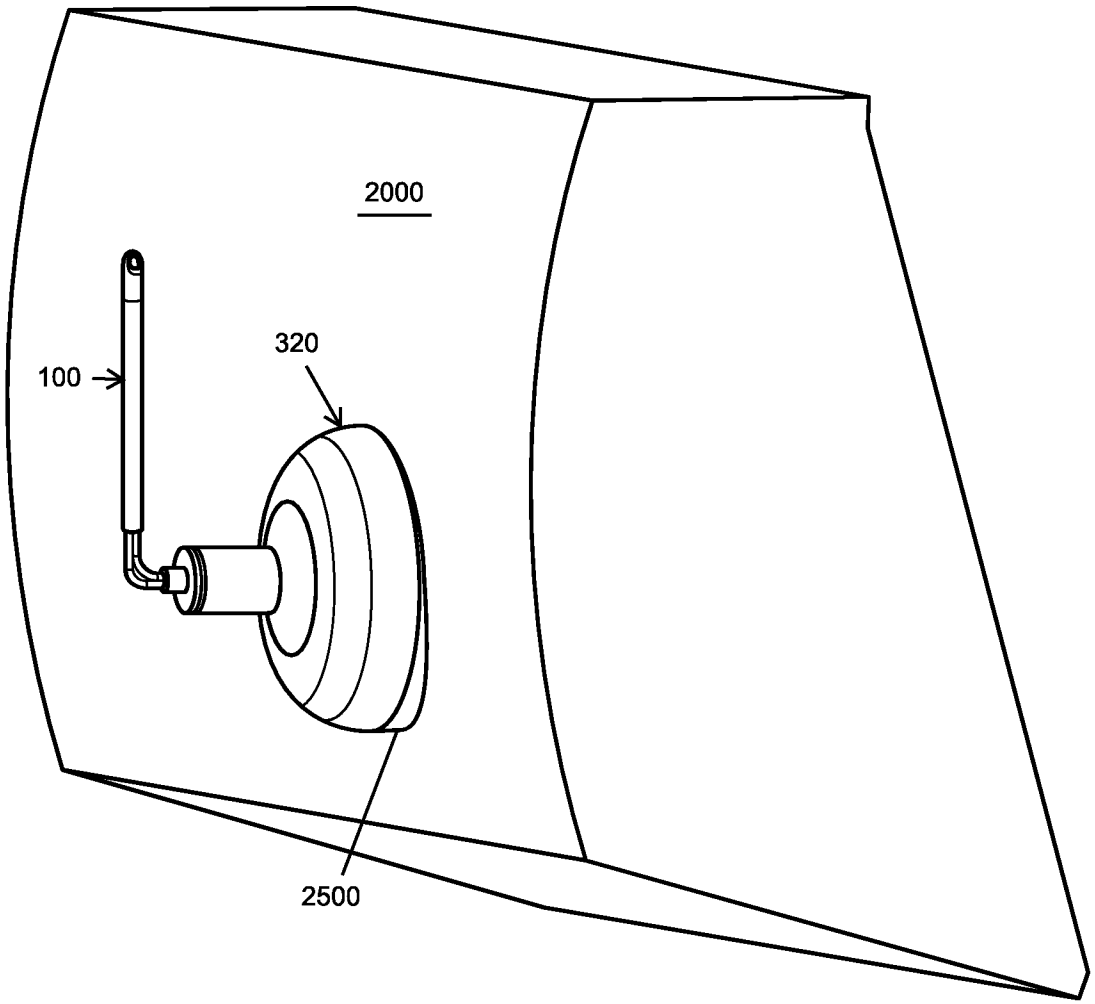
FIG. 6 is a perspective view of the view of FIG. 5.

Bump Our Arrangement:

With reference to FIGS. 3, 6 and 7 bladder 320 is generally cylindrical in shape with a generally cylindrical sidewall 340 that connects to a generally flat or rounded end wall 350. In this way, bladder 320 forms a generally cylindrical member which is effective at filling the opening 2500.

Figure 8:
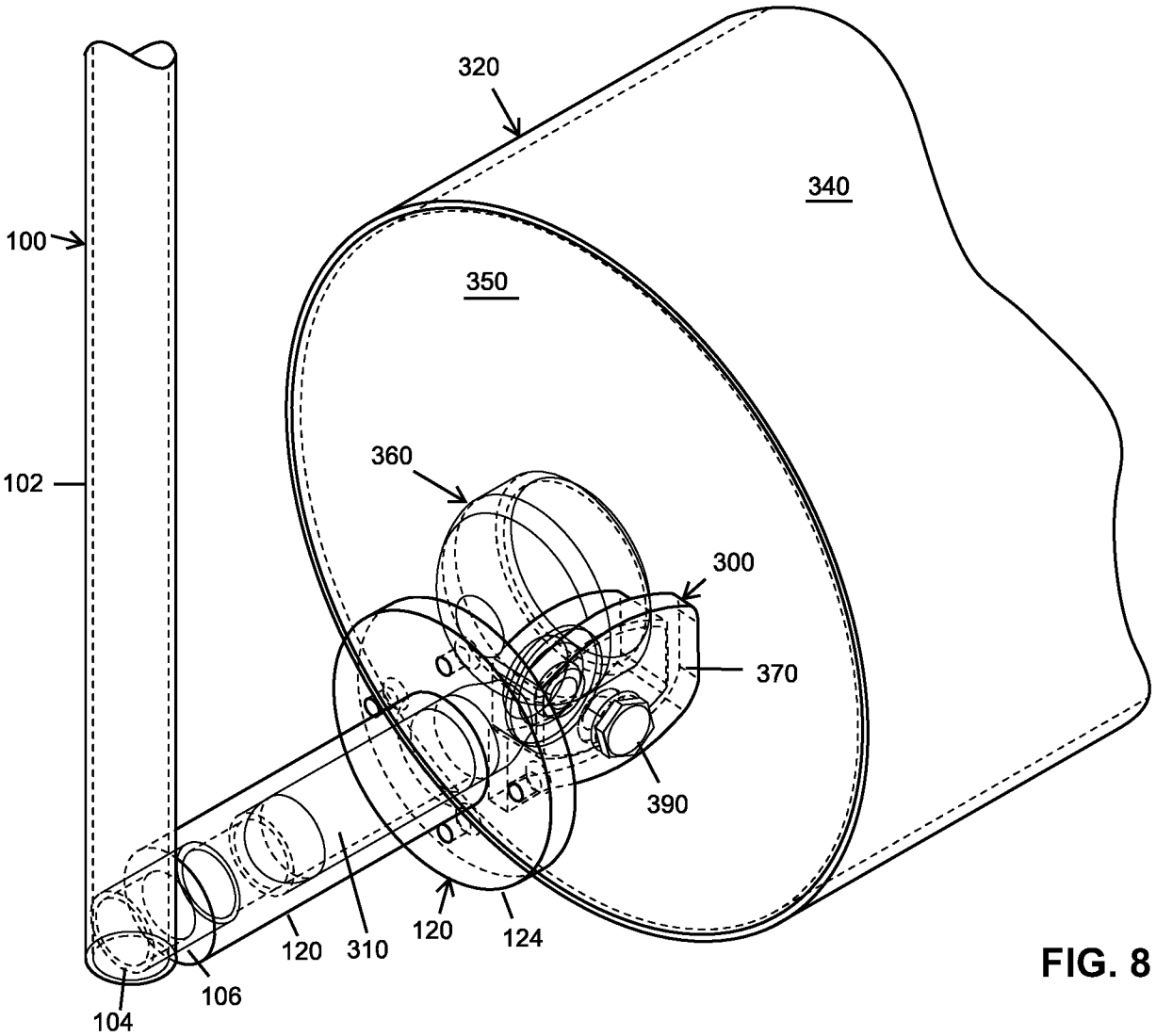
FIG. 8 is a perspective close-up view of an alternative arrangement of a yacht preserver; the view showing the air bladder having a generally cylindrical shape with a rounded sidewall and a generally flat end wall; the view showing a generally cylindrical bump connected to the center of the outward end wall of the air bladder and extending outward therefrom; the view showing the housing of an inflator device connected to the side of the bump of the air bladder by connection of a flange of a manifold to the material of the air bladder; the view showing a nut and a gas canister connected to the housing of the inflator device; the view showing the gas canister held within an opening of a collar connected to a handle; the view showing portions of the system in hidden lines.
Figure 9:
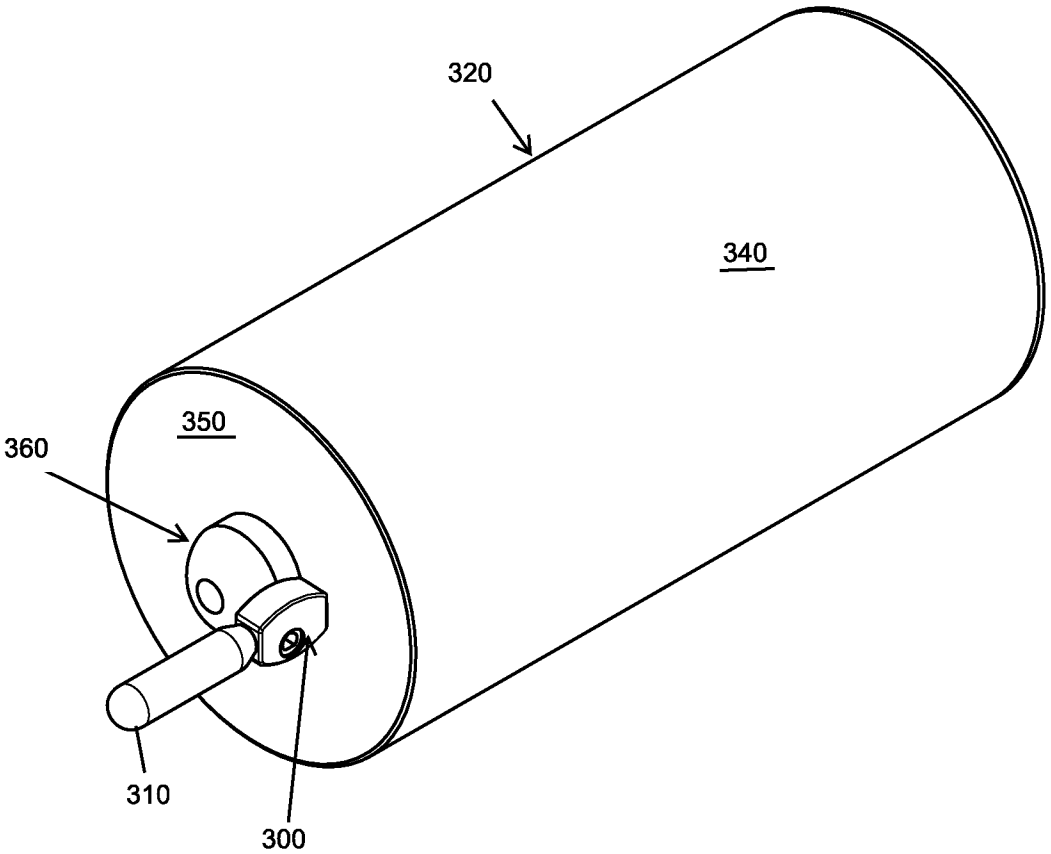
FIG. 9 is a perspective view of the yacht preserver system shown in FIG. 8, the view showing the full size of the air bladder; the view showing the inflator device connected to the bump of the air bladder; the view showing the gas canister connected to the inflator device; the view showing the handle removed.

In another arrangement, with reference to FIGS. 8 and 9, a yacht preserver system 1000 is presented which includes a bump 360 or protrusion in an end wall 350 that facilitates connection of inflator device 300 to bladder 320.

Inflator device 300 must connect to bladder 320 in some manner so as to facilitate the injection of gas into bladder 320 to cause bladder 320 to inflate. When no bump 360 is present, inflator device 300 either connects to sidewall 340 or end wall 350. In the event that inflator device 300 connects to sidewall 340, depending on how deeply inserted bladder 320 is within opening 2500 the inflation device 300 may be pinched or trapped between the sidewall 340 and the side of the opening 2500. In some situations, this may not be a bad thing. In other situations, this may be undesirable. In one arrangement, when handle 100 includes a collar 120 that holds gas canister 310 within a hollow interior of the collar, if the bladder 320 inflates while the bladder 320 is inserted too far within opening 2500, the collar 120 can get pinched or trapped between bladder 320 and opening 2500 thereby preventing the collar 120 and handle 100 from being removed after inflation. This may not be a problem in some situations. However, in some situations, it may be very undesirable to have handle 100 flopping around outside of opening 2500, which could cause damage to the yacht 2000 and/or the bladder 320.

To eliminate this problem, and to facilitate more-robust operation as it does not matter how far the bladder 320 is inserted within opening 2500, a bump 360 is connected to the outward end wall 350. Bump 360 is any rearward protrusion connected to bladder 320 that has a smaller side or a smaller diameter than sidewall 340. In the arrangement shown, as one example, bump 360 itself has a generally centrally positioned cylindrical sidewall that extends rearward from end wall 350 and extends rearward a distance before terminating in an end wall.

In the arrangement shown, inflator device 300 is connected to the sidewall of bump 360. The connection of inflator device 300 to the sidewall of bump 360 allows inflator device 300 to connect to bladder 320 in a manner that ensures that inflator device 300 does not get trapped or pinched between the inflated bladder 320 and the opening 2500 as a substantial amount of clearance is provided between the interior diameter of the opening 2500 and the exterior diameter of bump 360.

Detailed Configuration of Inflator Device:

In the arrangement shown, as one example, with reference to FIGS. 8-12, inflator device 300 is presented that facilitates the selective inflation of bladder 320 using gas canister 310. Inflator device 300 is formed of any suitable size, shape and design. In the arrangement shown, as one example, inflator device 300 includes a housing 370 that includes opposing faces 372, opposing end walls 374 and opposing sidewalls 376. Gas canister 310 is threaded into one end wall 374. A lever 378 is positioned in a sidewall 376 between opposing faces 372 and is connected at an end to cord 332 and pull handle 330. A safety mechanism 380 is placed adjacent the lever 378 and prevents unintentional movement of the lever 378. When pull handle 330 and cord 332 are pulled with sufficient enough force, safety mechanism 380 breaks and lever 378 pivots within housing 370 causing a puncture on an end of the gas canister 310 thereby releasing the gas held within the gas canister 310 through the inflator device 300 and into the bladder 320 thereby filling bladder 320 and sealing opening 2500.

In the arrangement shown, housing 370 includes an opening 382 in a face 372 that receives a threaded end of a manifold 384. Manifold 384 is formed of any suitable size, shape and design and facilitates connection between bladder 320 and housing 370. In one arrangement, as is shown, manifold 384 includes a threaded stem 386 that has a threaded exterior surface that facilitates a threaded connection to housing 370 and a hollow interior that allows the passage of gas or air through manifold 384.

Figure 10:
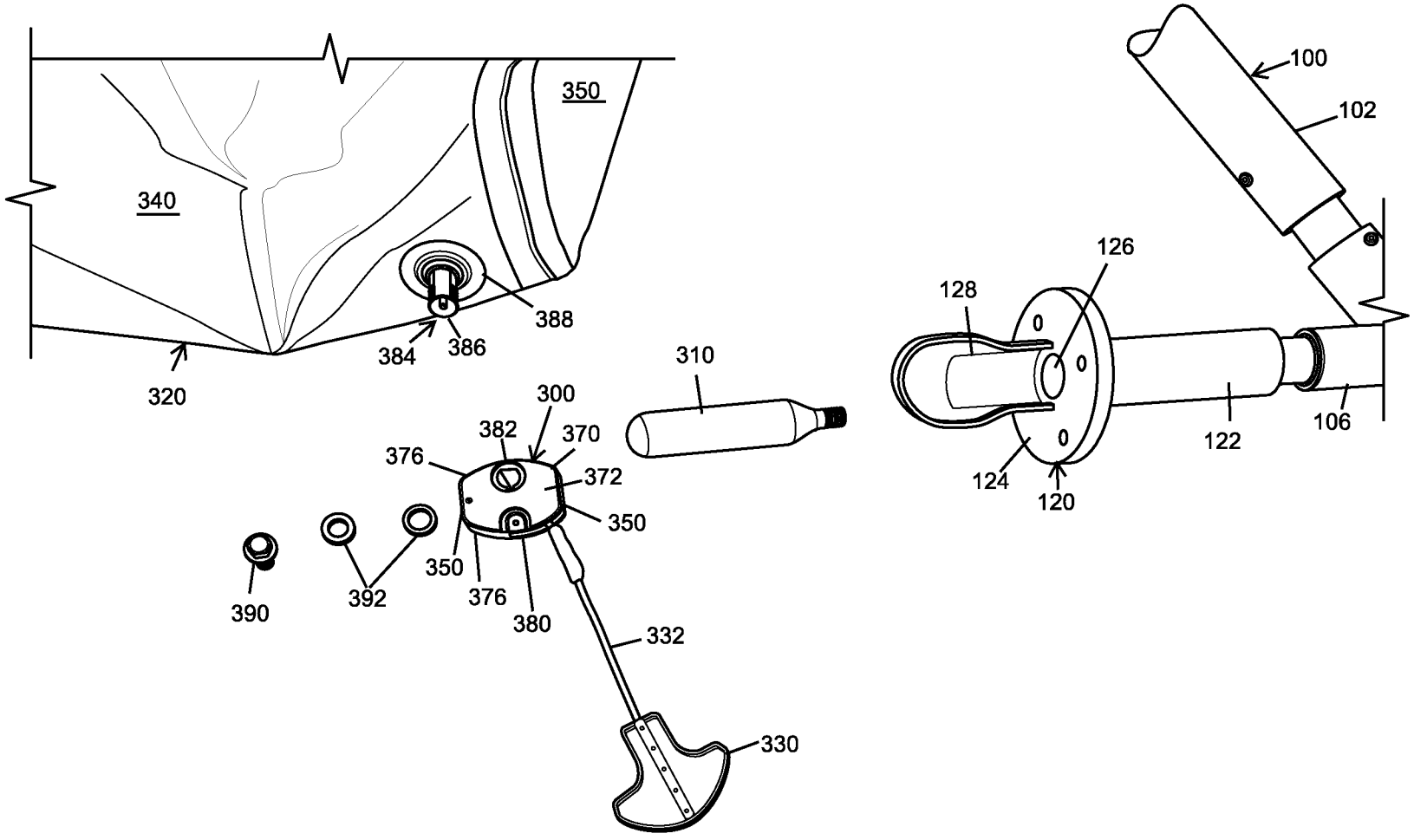
FIG. 10 is an exploded perspective view of a yacht preserver system; the view showing the air bladder having manifold connected to a sidewall of the air bladder; the view showing the housing of an inflator device having a cord and pull handle connected to the inflator device which are configured to initiate inflation of the air bladder; the view showing a nut and a gas canister that are connected to the housing of the inflator device; the view showing an opening of a collar connected to a handle that is configured to receive and hold the gas canister as well as provide alignment to the inflator device.
Figure 11:
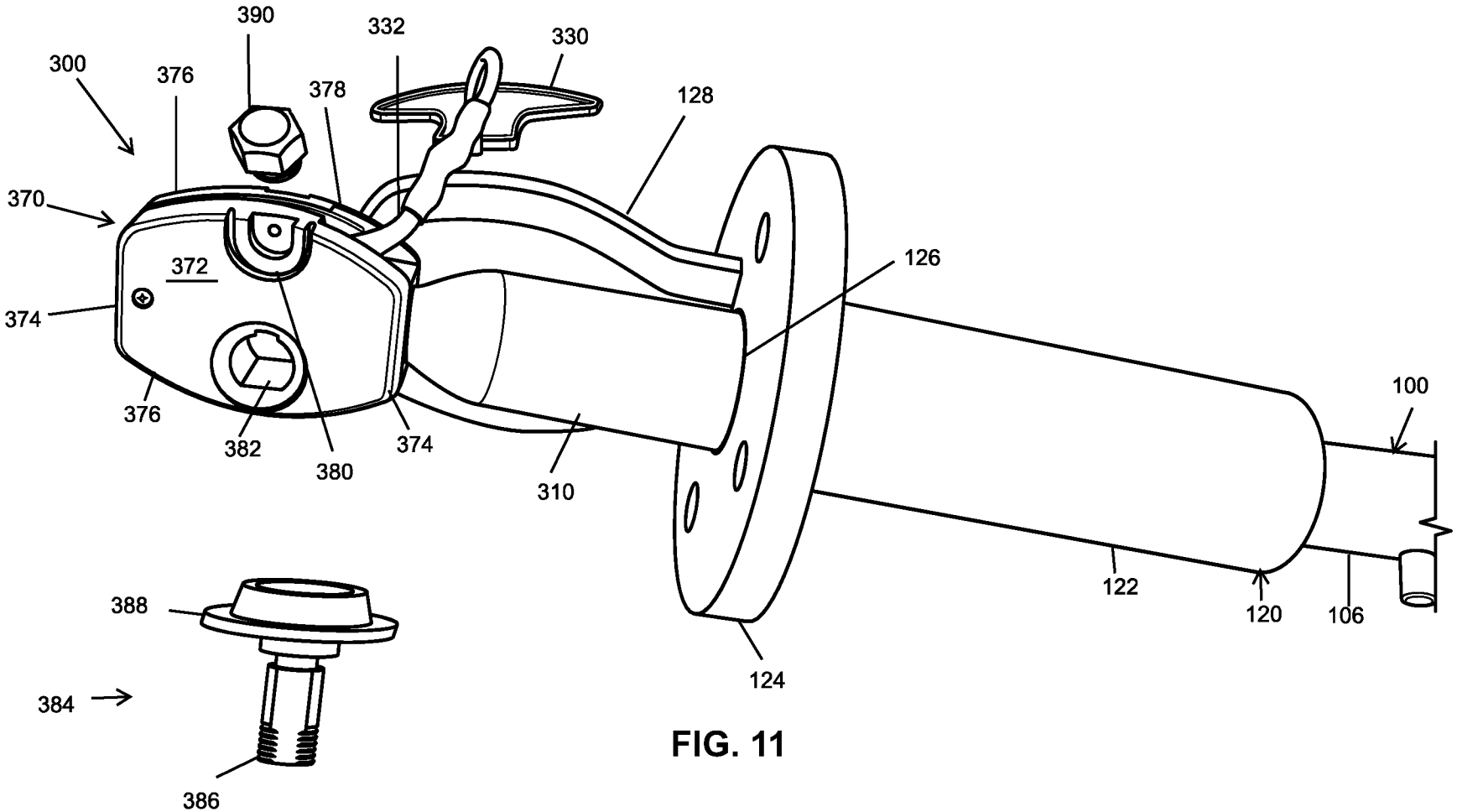
FIG. 11 is a perspective view of the yacht preserver system of FIG. 10, the view showing the gas canister inserted within the opening of the collar, the view showing the gas canister attached to the inflator device; the view showing the guide of the collar providing alignment to the gas canister and the inflator device; the view showing the manifold and the nut removed from the housing of the inflator device.
Figure 12:
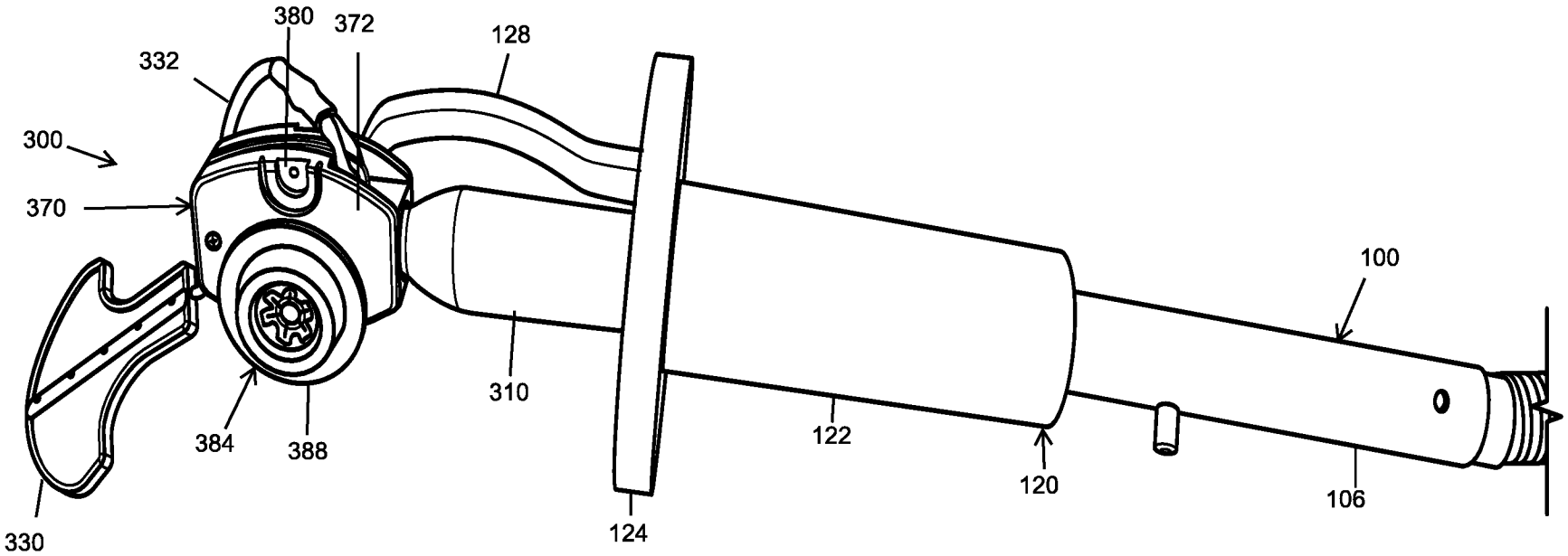
FIG. 12 is another perspective view of the yacht preserver system of FIG. 11, the view showing the nut and manifold installed on the housing of the inflator device; the view showing the flange and the valve of the manifold without the manifold connected to the air bladder.

A flange 388 is connected to an end of threaded stem 386 opposite the threads and opposite where threaded stem 386 connects to housing 370. Flange 388 is formed of any suitable size, shape and design and facilitates connection of manifold 384 to bladder 320. In one arrangement, flange 388 is a generally cylindrical member that extends outward from an end of threaded stem 386. Flange 388 facilitates connection to the material that forms bladder 320 by any manner method or means such as by gluing, welding, adhering, stitching or the like manners of connecting flange 388 to bladder 320. In one arrangement, as is shown, flange 388 includes an exterior layer that remains exterior to the material of bladder 320 and an interior layer that is inserted within the material of bladder 320. Flange 388 facilitates a strong, robust and durable connection to bladder 320. In one arrangement, as is shown in FIG. 10, flange 388 is connected to sidewall 340 of bladder 320. In another arrangement, as is shown in FIG. 8, flange 388 is connected to the exterior sidewall of bump 360 of bladder 320.

In one arrangement a nut 390 threads into an opening 382 of housing 370 on a side opposite where manifold 384 connects to housing 370. Nut 390 serves to seal the fluid passageways that extend through housing 370. In one arrangement, one or more sealing washers 392 are positioned within openings 382 to seal nut 290 and/or manifold 384 to housing 370 so as to prevent leakage of any air.

Yacht preserver system 1000 is assembled by installing threaded stem 386, which is connected to bladder 320, in an opening 382 in one face 372 of housing 370 and by installing nut 390 in an opening 382 in an opposing face 372 and tightening the components into housing 370. A gas canister 310 is threaded into an opening in an end wall 350 of housing 370. When deployment of the bladder 320 is needed, the uninflated bladder 320 is placed in opening 2500 of yacht 2000 and the handle 330 is pulled. As the handle 330 is pulled, the lever 378 rotates upon a pivot point and safety mechanism 380 is overcome and/or breaks allowing the continued rotation of the lever 378. As the lever 378 rotates, the gas canister 310 is punctured and gas flows from the gas canister 310 through housing 370, through the hollow interior of manifold 384, or more specifically through the hollow interior of threaded stem 386 and flange 388, and into bladder 320 thereby inflating bladder 320.

In one arrangement, the housing 370 of inflator device includes the valves described herein, such as a check valve and/or a pressure relief valve. In another arrangement, manifold 384 includes the valves described herein, such as a check valve and/or a pressure relief valve.

To help facilitate the placement of bladder 320 in the optimal position during inflation, inflator device 300 is connected to collar 120 that is connected to an end of the lower section 106 of handle 100. In one arrangement, as is shown, collar 120 includes a cylindrical member 122 that connects to the outward end of lower section 106. Cylindrical member 122 extends a length from the outward end of lower section 106 a distance and includes an outwardly extending flange 124 at its inward end, opposite the end that connects to lower section 106. An opening 126 is placed at the center or approximate center of collar 120. Opening 126 is sized and shaped to receive gas canister 310 therein with close tolerances. Opening 126 is configured to receive and hold gas canister 310 therein to facilitate deployment of bladder 320 and once bladder 320 is deployed the collar 120 and handle 100 is intended to be removed. In one arrangement, the handle 100 and collar 120 are removed from an inflated bladder 320 with an attached inflator device 300 and gas canister 310 by simply sliding the lower section 106 of the handle 100 away from the bladder 320. The gas canister 310 should slide out of the opening 126 when proper force is applied in cooperation with moving the lower section 106 of handle 100 away from bladder 320 along an axis that extends through the center of gas canister 310.

In one arrangement, as is shown in FIGS. 9 and 10, a guide 128 is positioned along one side of opening 126. Guide 128 is formed of any suitable size, shape and design and is configured to connect to and/or guide gas canister 310, inflator device 300 and/or bladder 320 prior to and during the inflation process. In one arrangement, guide 128 includes a semicircular extension that extends in similar fashion to the opening 126 past the outward end of flange 124. In this way, this portion of guide 128 guides and extends along a side of gas canister 310. In the arrangement shown, guide 128 also includes a looped member extends around the outward edges of portion of guide that extends along the side of gas canister 310. Like the other portion of guide 128, this portion of guide 128 facilitates alignment and guidance of gas canister, housing 370 and bladder 320.

In one arrangement, the portions of guide 128 only frictionally engage the gas canister 310 and inflator device 300 and bladder 320 in such a way that once a force is applied that is greater than the frictional engagement the two components separate from one another. In another arrangement, a breakable connection device is also used to connect these components together such as a breakable adhesive, a strip of plastic, a piece of hook and loop material (such as Velcro) or the like. The addition of the breakable connection device helps to ensure that unintentional separation does not occur.

Permanently Installed Arrangement:

In an alternative arrangement, with reference to FIGS. 19-23, an alternative arrangement of a yacht preserver system 1000 is presented. In this arrangement, yacht 2000 includes an exhaust tube 500 that connects at one end to the exhaust output of the engine(s) 490 of the yacht 2000 and then exits the bottom of the hull 510 at opening 2500, however, it is contemplated that the exhaust tube 500 may exit any portion of the hull 510.

Many yachts 2000 have the exhaust tube 500 in communication with the bottom of the hull 510, at or below the water line, so that the noise and gasses of the exhaust system are pumped into the water below the yacht 2000 thereby providing quieter and more appealing operation of the yacht 2000. One problem with this common arrangement however is that when an issue arises and the opening 2500 and/or exhaust tube 500 must be plugged this requires a person to go overboard the yacht 2000 and swim under the yacht 2000 to plug the opening 2500.

Having to get into the water to plug the opening 2500 is substantially unappealing and can be very dangerous. This is especially true because many times when a yacht 2000 encounters a catastrophic failure that requires the opening 2500 to be plugged this is because something has broken because the yacht 2000 is enduring heavy seas. When the seas are several feet and the yacht 2000 is substantially moving with every wave, it is difficult if not impossible to plug the opening 2500 from the outside of the yacht 2000.

In addition, other factors can increase the difficulty or undesirability of plugging the opening 2500 by getting into the water. As one example, it is very undesirable to attempt to plug the opening 2500 from the water when the yacht 2000 is in very cold waters. As another example, it can be very undesirable to attempt to plug the opening 2500 from the water when it is night time. As yet another example, it can be very undesirable to attempt to plug the opening 2500 when the water has reduced visibility as it is difficult to see under water. As yet another example, it can be very undesirable to attempt to plug the opening 2500 when the yacht is in shark infested waters. Many other factors may make it more difficult to plug the opening 2500 from under water.

To address these issues, and alleviate the problems associated with plugging opening 2500 from beneath the yacht 2000 and under water, a yacht preserver system 1000 is connected to yacht 2000 having a container 520 that is connected to an opening 530 in exhaust tube 500. Container 520 includes a hollow interior 540 that stores bladder 590 therein and is covered by sealing member 550 that seals the opening 530 between the exhaust tube 500 and the hollow interior 540 of container 520. In the arrangement shown, container 520 includes inflator device 560 wholly or partially within the hollow interior 540 of container 520. In one arrangement, as is shown, inflator device 560 includes a hose 570 that fluidly connects at one end to a source of pressurized air 580, such as gas canister 310 as is described herein, and connects at an opposite end to bladder 590. A valve 600, such as valve 420 as is described herein, is positioned between the source of pressurized air 580 and the bladder 590. The inflator device 560 includes a control mechanism 610 that initiates the flow of air into bladder 590. Control mechanism 610 may be a manual control, such as a pull cord, lever, trigger, button, or the like that manually actuates the bladder 590, or alternatively control mechanism 610 is an electronic control that is electrically connected to and controlled by a controller 620 that is electrically connected to the control system of yacht 2000 and/or engine 490. Also, one or more sensors 630 are electrically connected to the controller 620 that sense one or more conditions that may be used to initiate inflation of the bladder 590, as is described herein.

In one arrangement, as is shown, a container 520 is connected to exhaust tube 500. Container 520 is formed of any suitable size, shape and design and is configured to house various components of the system, as is described herein. In one arrangement, as is shown, the opening 530 in exhaust tube 500 is generally cylindrical in nature and includes threads in its upper end. In this arrangement, the lower end of container 520 has a similar arrangement of a cylindrical opening with threads therein that are configured to engage and mate with the threads in opening 530. In this arrangement, container 520 is attached to exhaust tube 500 by threaded engagement. However, any other design, manner or method of connecting two components together are hereby contemplated for use such as a matching collar and groove arrangement that facilitates connection by use of one or more clamps, an overlapping flange and seal arrangement that is screwed or bolted together, or any other arrangement of connecting two components together.

In the arrangement shown, opening 530 in exhaust tube 500 is positioned in the upper side of the exhaust tube 500. This arrangement is advantageous as it separates the container 520 from the water and other materials and contaminants that often flow through exhaust tube 500. As such, by positioning container 520 in the upper end of exhaust tube 500 this tends to keep the container 520 separated from most of the water that flows through the exhaust tube 500 and thereby extends the life of the system. However, container 520 can be positioned in any portion or positioning of exhaust tube 500. One advantageous position may be at the side of exhaust tube 500 as the side keeps clear of the contaminants that flow through the bottom of the exhaust tube 500 but the side does not receive the same amount of heat as the top of the exhaust tube 500.

Container 520 includes a hollow interior 540 that is formed to house the components of the system as is described herein. Hollow interior 540 is formed of any suitable size, shape and design. In one arrangement, in a storage position, (prior to deployment of bladder 590) all or a portion of the hose 570, the bladder 590 and valve 600 are held within the hollow interior 540 of container 520. In one arrangement, the source of pressurized air 580, control mechanism 610, controller 620, control mechanism 610, controller 620 and/or sensor 630 may also be held wholly or partially within the hollow interior 540 as well.

In the arrangement shown, as one example, sealing member 550 closes the open end of hollow interior 540. Sealing member 550 is formed of any suitable size, shape and design and is configured to close the open end of container 520 thereby separating the contents of container 520 from the heat, fluids and contaminants that pass through the hollow interior of exhaust tube 500 while allowing bladder 590 to escape out of container 520 to seal the hollow interior of exhaust tube 500 upon deployment. Sealing member 550 is formed of any device or configuration that separates two spaces while allowing bladder 590 to pass there through upon deployment. In one arrangement, as is shown, sealing member 550 is a flexible and breakable or rigid and breakable or semi-rigid and breakable membrane that extends across the opening 530 between container 520 and exhaust tube 500. Sealing member 550 may be formed of a metallic material, a ceramic material, a plastic material, or any other material or combination thereof. Upon deployment, sealing member 550 breaks, bends, articulates or otherwise allows bladder 590 to pass through the sealing member 550 and into the hollow interior of exhaust tube 500 thereby sealing exhaust tube 500.

Inflator device 560 is formed of any suitable size, shape and design and is configured to inflate bladder 590. In the arrangement shown, as one example, inflator device 560 includes hose 570, source of pressurized air 580, bladder 590, valve 600, control mechanism 610, controller 620 and/or sensor 630, among any other components. In combination with these components, inflator device 560 operates to seal exhaust tube 500.

Inflator device 560 includes a hose 570. Hose 570 is formed of any suitable size, shape and design and serves to fluidly connect the source of pressurized air 580 to the bladder 590. In the arrangement shown, as one example, hose 570 is a rigid or flexible hose that connects to the source of pressurized air 580 (which may be within the hollow interior 540 of container 520 or exterior to container 520) on one end and connects to bladder 590 and/or valve 600 on an opposite end. Being flexible allows hose 570 to move and adjust position in the transition of bladder 590 going from a deflated position to an inflated position. Being flexible also allows for packing of the container in a tight and space-efficient manner.

Source of pressurized air 580 is formed of any suitable size, shape and design and serves to provide pressurized air, on command, to the bladder 590 to inflate the bladder and seal the exhaust tube 500. Source of pressurized air 580 may be similar to or identical to gas canister 310 described herein. In the arrangement shown, as one example, source of pressurized air is a gas canister or CO2 cartridge, as is described herein, that is positioned just exterior to the container 520. In an alternative arrangement, source of pressurized air 580 may be positioned wholly within container 520, such as one or more gas canisters held within container 520. This arrangement provides the benefit of being a sealed, unitary and all in one device without or with minimal exterior components. In an alternative arrangement, source of pressurized air 580 may include a combination of gas canisters (which may be within or exterior to container 520) as well as a connection to the air pressure system 400 of yacht 2000 as is described herein. The combination of the use of gas canisters as well as a connection to an air pressure system 400 provides the benefits of fast inflation from the gas canister as well as a steady and unlimited supply of pressurized air from the air pressure system 400. Positioning the gas canister within the hollow interior 540 of container 520 provides the benefits of sealing the gas container from contamination as well as providing protection to the gas canister by the rigid container 520, but this arrangement requires removal of the container 520 to service or replace the gas canister. Alternatively, positioning the gas canister outside the hollow interior 540 of container 520 provides the benefits of making it easier to replace the gas canister, but this arrangement exposes the gas canister to external interference and perhaps damage or increased decay due to environmental factors.

Valve 600 is formed of any suitable size, shape and design and acts like valve 420 described herein and therefore may be similar to or identical to valve 420 (including having handle 430 in some arrangements). That is, valve 600 facilitates the flow of air into bladder 590 while preventing unintentional airflow out of bladder 590.

Control mechanism 610 is formed of any suitable size, shape and design and serves to initiate the flow of air from the source of pressurized air 580 through hose 570 and into bladder 590 to inflate the bladder and seal the exhaust tube 500. While in the arrangement shown, control mechanism 610 is not shown, control mechanism 610 may be a puncture device which punctures a seal in a gas canister thereby initiating the flow of gas, control mechanism 610 may be a controllable valve that initiates the flow of air from a gas canister or air pressure system 400, or it may be any other device that initiates the flow of gas into bladder 590. Control mechanism 610 is controlled by controller 620.

Controller 620 is formed of any suitable size, shape and design and serves to control operation of control mechanism 610 and initiate flow of air into bladder 590. In one arrangement controller 620 is a manual control device such as a lever, trigger, knob, button, pull cord, a switch or any other device that is manually activated by a user thereby initiating inflation of bladder 590. This manual controller 620 may be placed directly on or in close proximity to container 520 or alternatively this manual controller 620 may be placed at a remote location such as in the wheel house or flying bridge of the yacht 2000.

In an alternative arrangement, controller 620 is electrically connected to the control system of yacht which control operation of the control mechanism 610. In this arrangement, controller 620 may be a microprocessor that senses various characteristics of the yacht 2000 and when various predetermined characteristics are met the controller 620 determines to initiate inflation of the bladder 590 to save the yacht 2000. This may be determined based on the amount of water in the hull 510 of the yacht 2000, based on the tilt of the yacht 2000, based on the amount of water flowing into the yacht 2000 through exhaust tube 500 (as is further described herein) or based on any other sensed characteristic or combination thereof. In one arrangement, the electrical system of yacht 2000 ensures the engine(s) 490 are turned off at the time the bladder 590 is inflated.

In one arrangement, controller 620 is electrically connected to one or more sensors 630 that sense characteristics of yacht 2000 and based on this information, and when controller 620 is a microcontroller or microprocessor, based on instructions stored on memory of the microcontroller or microprocessor, controller 620 determines to initiate inflation of bladder 590. In one arrangement, as is shown, sensor 630 is a flow meter or flow sensor that senses the amount of water and/or speed of water flowing through exhaust tube 500 and/or the direction of flow. In one arrangement, as is shown, sensor 630 is a paddle-wheel type flow sensor that is positioned in the lower portion of or bottom of exhaust tube 500, however any other form of sensor is hereby contemplated for use.

In this arrangement, when sensor 630 senses a substantial amount of water flow in the wrong direction within exhaust tube 500 the sensor 630 senses this information and transmits it to the control mechanism 610 which determines whether to initiate deployment of bladder 590. In an alternative arrangement, sensor 630 transmits the water flow information to a display, signal or other indicator to a user, such as the captain, who makes the determination based on this information, whether to deploy the bladder 590. The deployment may be made manually, such as by pulling a trigger, pulling a lever, pressing a button, pulling a cord or by any other manner. Alternatively, the deployment may be performed electronically by initiating a command through a button press, a touch screen, a click of a button or the like. Alternatively, the control mechanism 610 may inform the user, or captain, that it has detected a condition that warrants deployment of the bladder 590 and that deployment will occur within a predetermined amount of time, such as 20 seconds, or the like, unless the user manually overrides the deployment. If the deployment is not manually overridden, within the predetermined amount of time, the control mechanism 610 deploys the bladder 590.

In operation, when controller 620 activates control mechanism 610, control mechanism 610 initiates the flow of air through the hose 570, valve 600 and into bladder 590. As the bladder 590 expands, the sealing member 550 gives way allowing bladder 590 to escape into the exhaust tube 500. As the bladder 590 fills and pressurizes the bladder 590 seals against the interior surface of exhaust tube 500 thereby preventing the flow of water into yacht 2000 through exhaust tube 500.

After the issue has been resolved, and the bladder 590 is no longer needed to seal the exhaust tube 500, the controller 620 and/or control mechanism 610 may be used to deflate bladder 590. Next, the container 520 is removed from the opening 530 in the exhaust tube 500 and either a new container 520 is installed or the container 520 is reconditioned by repacking the bladder 590, repairing or replacing the sealing member 550, replacing the disposable gas containers when used as the source of pressurized air 580 or refilling the gas container when a refillable gas container is used. Once reconditioned, the container 520 is installed on the opening 530 and the system is ready for use again.

One benefit of this permanently installed system 1000 is that after deployment of the air bladder 590, the container 520 may simply be removed from opening 530 and another container 520 may be installed. Or, alternatively, if it is not desired to install another container 520 a simple cap may be installed on opening 530 that simply seals exhaust tube 500 and eliminates the use of the yacht preserver system 1000. In one arrangement, yachts 2000 are sold with opening 530 in exhaust tube 500 that is covered by a simple cap. Then, as an accessory or an after-market add-on the user may install yacht preserver system 1000 by installing container 520 on opening 530 thereby improving the safety of yacht 2000.

Alternative Inflation Methods:

While discussion is made herein to inflation of bladder 320/590 through the use flowing pressurized gas from gas canister 310 and/or source of pressurized air 580 in alternative embodiments it is hereby contemplated that other materials may be used to inflate bladder 320/590. In one arrangement, water or another fluid is contemplated for use in inflating bladder 320/590. The use of water or a fluid provides the benefit that the bladder 320/590, once filled, is generally neutral to the water that is trying to infiltrate the yacht 2000. That is, in contrast, when bladder 320/590 is filled with gas, bladder 320/590 is very buoyant in comparison to the water that is trying to infiltrate the yacht 2000. In addition, when bladder 320/590 is filled with water or another fluid, the liquid is not compressible, whereas the gas will compress under increased pressure. In addition, when bladder 320/590 is filled with water or another fluid, the fluid is less likely to escape through the seams and/or material of bladder 320/590 as compared to when bladder 320/590 is filled with a gas. As such, using to inflate bladder 320/590 has a number of substantial benefits.

In another arrangement, any other material in addition to using a gas or a fluid to fill bladder 320/590 is hereby contemplated for use. As one example, use of a flowable foam is contemplated. Flowable foam provides many of the benefits of filling bladder 320/590 with a gas, such as ease of filling and speed of filling. Use of a flowable foam to fill bladder 320/590 also provides the benefits that foam, especially if the foam is such that it hardens or cures, is less compressible than gas, and is less likely to flow out of bladder 320/590 than a gas. In one arrangement, foam that fills bladder 320/590 hardens over time thereby requiring additional steps to remove the foam-filled bladder 320/590 once the bladder 320/590 is no longer needed.

Figure 13:
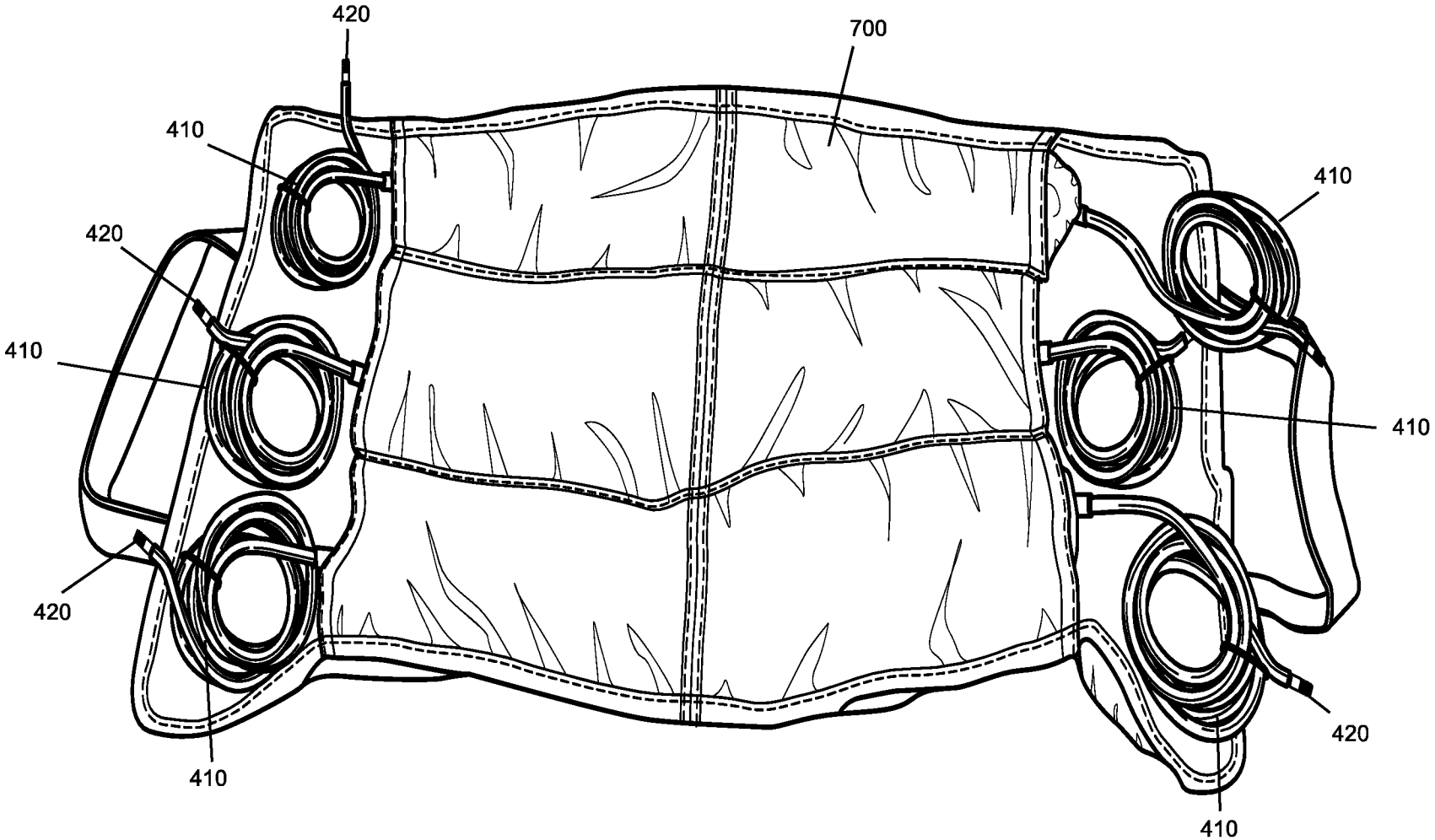
FIG. 13 is a perspective view of a storage device for yacht preserver systems; the view showing six yacht preservers of various sizes stored within the storage device.

Storage Device:

With reference to FIG. 13 a plurality of yacht preserver systems 1000 are held within a storage device 700. Storage device 700 is formed of any suitable size, shape and design and is configured to store and protect one or more yacht preserver systems 1000 therein. In one arrangement, as is shown, storage device 700 is a flexible device that holds and protects six yacht preservers systems 1000, however any number is hereby contemplated for use. Although it has been contemplated that it is desirable to sell yacht preserver systems 1000 in pairs as it is desirable to have a backup yacht preserver 1000 when one is deployed. In the arrangement shown, as one example, the storage device 700 is shown storing yacht preserver systems 1000 that are inflated by an air pressure system 400. It is hereby contemplated that a similar if not identical storage device 700 can be used with self-inflating yacht preserver systems 1000.

ALTERNATIVE ARRANGEMENT(S)

With reference to FIGS. 24-29 various additional features and alternatives of system 1000 are presented. Some components of the system presented in FIGS. 24-29 are similar to components of the system 1000 presented in FIGS. 1-23 and therefore all of the teaching presented herein with respect to FIGS. 1-23 applies equally to and is incorporated into the system 1000 presented in FIGS. 24-29 unless specifically stated otherwise.

Alternative System 1000:

FIG. 24-29 shows alternative a yacht preserver system 1000 in accordance with one or more embodiments. The yacht perverse system is formed of any suitable size, shape, or design and is configured to facilitate insertion of an inflatable bladder 320/590 into an opening 2500 of a yacht 2000 and inflate the bladder 320 to seal opening 2500.

In the arrangement shown in FIGS. 24-29, as one example, system 1000 includes a handle 800, an inflator device 802, a hose 804, and an inflatable bladder 320/590, among other components.

Handle 800:

Handle 800 is formed of any suitable size, shape, or design and is configured to facilitate reaching over a side of a yacht and placing an inflatable bladder 320/590 in an opening of the yacht to be sealed. In the arrangement shown, as one example, handle has a generally elongated shape extending from an upper end 810 to a lower end 812. In this example arrangement, handle 800 is generally L-shaped member having a generally elongated upper section 814 that connects at its lower end to a corner section 816 that connects to lower section 818 that extends approximately perpendicularly to the length of upper section 102.

In one arrangement, as is shown, the inward end of lower section 818 is temporarily connected to inflatable bladder 320/590. The L-shape may make it relatively easy for a user to position the inflatable bladder 320/590 inside the opening 2500. Inflatable bladder 806 may be connected to lower section 818 by various types of fasteners including but not limited to, for example, gluing, adhering, pinning, stitching, clips, snaps, and/or hook and loop material.

Figure 30:
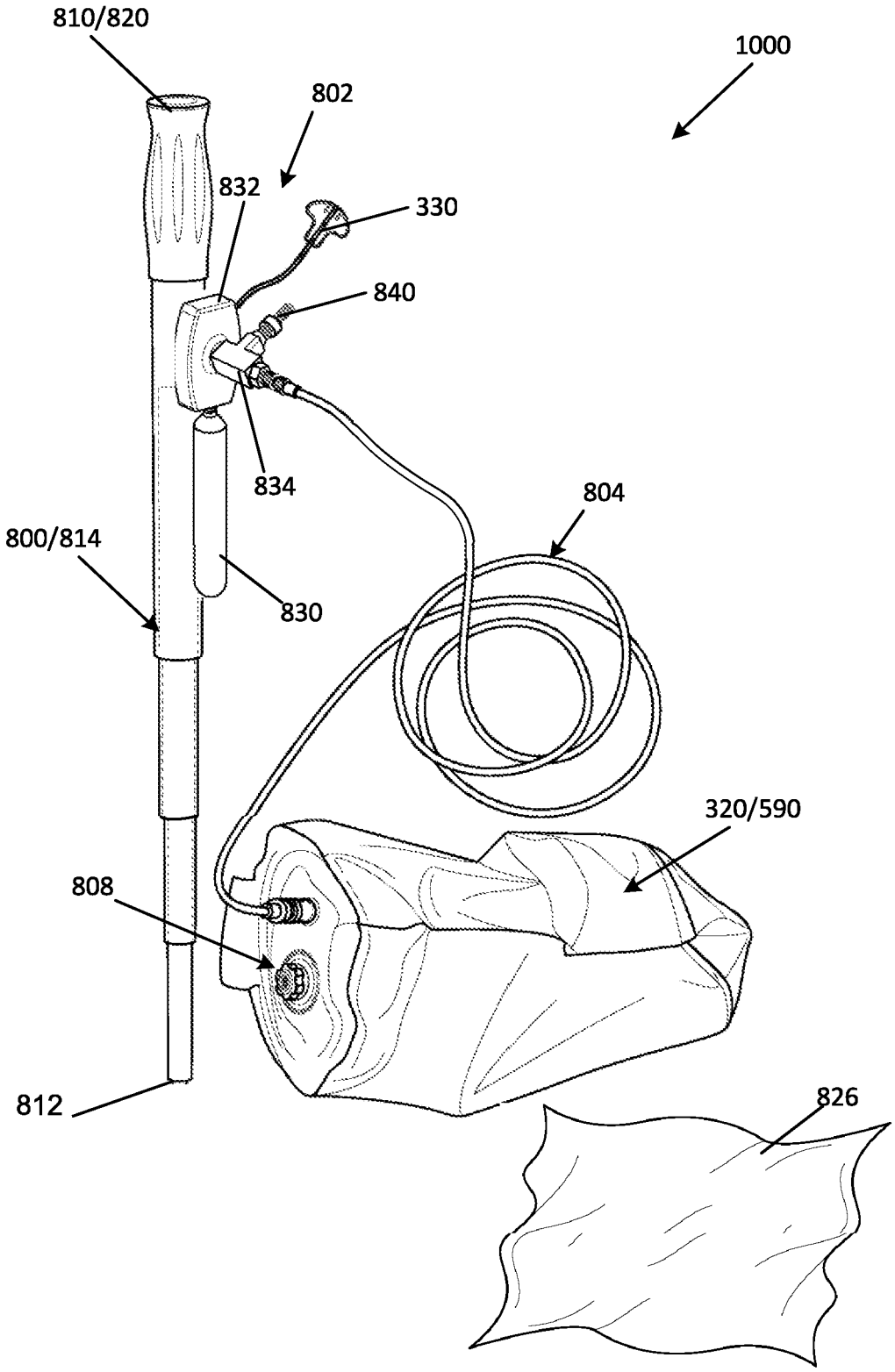
FIG. 30 is a side view of an example yacht preserver, in accordance with one or more arrangements; the view showing the yacht preserver with a strait handle; the view showing the handle detached from the inflatable bladder and the inflatable bladder partially inflated.

Although some arrangements may be primarily illustrated or described with reference to handle 800 having an L-shape or 90 degree corner 816, embodiments are not so limited. Rather, it is contemplated that in one or more arrangements handle 800 of system 1000 may have a strait elongated shape (e.g., as shown in FIG. 30) or any other shape, curve or angle configured to facilitate reaching over a side of a yacht and placing an inflatable bladder 320/590 in an opening of the yacht to be sealed.

In the arrangement shown handle 800 includes a handgrip 820 positioned as upper end 810 of handle 800. The handgrip 820 may help the user maintain control of the yacht preserver system 1000. The handgrip 820 may also help prevent the yacht preserver system 1000 from slipping out of the user's hand and falling into the water. Additionally or alternatively, handgrip 820 and may be omitted, replaced or augmented by another structure such as a lanyard 110, grip, clasp, hook, loop, or the like.

In the arrangement shown, upper end 810 of handle 800 is a telescoping pole. In this example arrangement, a user may extend the length of the telescoping upper end and lock into place for use to deploy bladder 320/590 inside the opening 2500. This telescoping arrangement allows system 1000 to be stored more compactly when not in use. Additionally or alternatively, this telescoping arrangement allows length to be adjusted to better accommodate different size yachts.

Bladder 320/590:

Bladder 320/590 is formed of any suitable size, shape, or design and is configured to, when inflated, expand to a volume sufficient to plug an opening 2500 in a yacht 2000. In the arrangement shown, as one example, bladder 320/590 is folded rolled or otherwise formed in a deflated state to facilitate temporary attachment to lower section 818 of handle 800. In one or more arrangements, bladder 320/590 is folded or rolled around lower section 818 of handle 800 and secured in place by a temporary fastener such as glue, adhesive, pins, stitching, clips, snaps, and/or hook and loop material. In the arrangement shown, as one example bladder 320/590 secured to lower section 818 of handle 800 by a cover 826 (or bag 826). The cover 826 may include a temporary fastener (not shown), such as a hook and loop fastening system (such as Velcro®) that allows the cover 826 to automatically open upon inflation and allow the cover 826 to be re-closed and the system re-packed after deflation. Alternatively, the cover 826 may include a non-reusable fastening system that breaks or is destroyed upon inflation, such as a tear-line or seam or similar weak spot in the cover 826 that opens upon inflation. Either way, the use of a cover 826 or container or other enclosing member serves the dual purpose of keeping the components of the system clean and free of contamination as well as maintaining the components of the system in a desired configuration, such as properly folded and aligned.

When inflated, bladder 320/590 expands and breaks the connection of temporary fastener of cover 826, thereby disconnecting bladder 320/590 from handle 800. Cover 826 is free to float away or may become stuck between bladder 320/590 and opening 2500. If cover 826, becomes stuck between bladder 320/590 and opening 2500, cover will not interfere with the ability of bladder 320/590 to seal opening 2500.

In the arrangement shown in FIGS. 24-29 bladder 320/590 includes a safety pressure release valve 808. Pressure release valve 808 is formed of any suitable size, shape, or design and is configured to release air from bladder 320/590 to prevent pressure in bladder 320/590 from exceeding a threshold pressure that may cause bladder 320/590 to become over inflated. Additionally or alternatively, pressure release valve 808 may be connected to hose 804 or inflation device 802 to prevent pressures from exceeding the threshold pressure.

Hose 804:

Hose 804 is formed of any suitable size, shape and design and serves to fluidly connect a source of pressurized air to the bladder 320/590. In the arrangement shown, as one example, hose 804 is a rigid or flexible hose that connects bladder 320/590 to inflator device 802. Being flexible allows hose 804 to move and adjust position in the transition of bladder 590 going from a deflated position to an inflated position. Being flexible also allows for packing of the container in a tight and space-efficient manner. Being flexible also allows length of the telescoping upper section 814 of handle 800 to be adjusted.

Inflator Device 802:

Inflator device 802 is formed of any suitable size, shape and design and serves to initiate and provide a flow of pressurized air through hose 804 and into bladder 320/590 to inflate the bladder 320/590 and seal opening 2500.

In the arrangement shown inflator device 802 includes a gas canister 830 and an activation device 832. Activation device 832 is formed of any suitable size, shape and design and serves to initiate flow of air from gas canister 830 into bladder 320/590 when activated by a user. In the arrangement shown, activation device includes a valve 834 configure to control flow of air into bladder 320/590 while preventing unintentional airflow out of bladder 320/590. In the arrangement shown, valve 834 is a pull cord triggered valve, configured to permits flow of gas from gas canister 830 to bladder 320/590 once the cord is pulled. However, embodiments are not so limited. Rather is contemplated that valve 834 may be actuated by various other mechanisms including, for example a lever, trigger, knob, button, a switch or any other device that is manually activated by a user. Additionally or alternatively, in one or more arrangements, activation device 832 may be formed by a puncture device, which punctures a seal in a gas canister thereby initiating the flow of gas.

In the arrangement shown, inflator device 802 includes a secondary 840 in fluid connection with the air hose. The secondary valve 840 is formed of any suitable size, shape and design and is configured to facilitate injection of additional air into hose 804 to maintain inflation of bladder 320/590 once gas canister 830 is used. That is, secondary valve 840 facilitates the flow of air into bladder 590 while preventing unintentional airflow out of bladder 320/590. In the arrangement shown, as one example secondary valve is a Schrader valve, thereby permitting inflation of bladder 320/590 to be maintained with a hand pump 842 (e.g., a bicycle pump).

Example embodiments have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

The invention claimed is:

1. A system for sealing an opening in a yacht, comprising:
a handle;
the handle having an elongated shape extending from an upper end to a lower end;
an inflator device connected to the handle at a position proximate to the upper end;
the inflator device having a gas canister and an activation device;
an inflatable bladder attached to the lower end of the handle;
a hose having one end connected to the inflator device and a second end connected to the inflatable bladder;
wherein the hose is connected to the inflator device at a connection point more proximate to the upper end of the handle than the lower end;
wherein upon activation of the activation device, the inflator device is configured to pass pressurized air from the gas canister through the hose to the inflatable bladder, thereby inflating the inflatable bladder and thereby sealing the opening in the yacht.

2. The system of claim 1, wherein the handle has a hand grip at the upper end.

3. The system of claim 1, wherein the handle includes a bend at the lower end;
wherein the inflatable bladder is deflated and wrapped around the bend of the handle.

4. The system of claim 1, wherein the handle includes a bend at the lower end;
wherein the inflatable bladder is deflated and wrapped around the bend of the handle; and
further comprising a break away cover covering the inflatable bladder.

5. The system of claim 1, wherein the handle includes a bend at the lower end;
wherein the inflatable bladder is deflated and wrapped around the bend of the handle; and
further comprising a break away cover covering the inflatable bladder;
wherein the break away cover includes a hook and loop material configured to hold the cover in place until the inflatable bladder is inflated.

6. The system of claim 1, wherein the activation device is activated by a pull string.

7. The system of claim 1, wherein the activation device is activated by hand valve.

8. The system of claim 1, wherein an inflator device includes a Schrader valve in fluid connection with the hose.

9. The system of claim 1, wherein the inflator device is detachable from the handle.

10. The system of claim 1, wherein the handle is a telescoping pole.

11. The system of claim 1, wherein the inflatable bladder includes a safety pressure release valve; and
wherein the safety pressure release valve is configured and arranged to prevent the inflatable bladder from becoming over inflated.

12. The system of claim 1, wherein the valve includes a regulator that regulates pressure within the inflatable bladder.

13. A method of installing a device to prevent a yacht from sinking and removing said device comprising;
providing the device, the device including:
a handle;
the handle having an elongated shape extending from an upper end to a lower end;
the handle having a hand grip at the upper end;
an inflator device connected to the handle at a position proximate to the handle;
the inflator device having a gas canister, an activation device;
an inflatable bladder attached to the lower end of the handle;
a hose having one end connected to the inflator device and a second end connected to the inflatable bladder;
wherein the hose is connected to the inflator device at a connection point more proximate to the upper end of the handle than the lower end;

reaching over a side of a yacht using the handle;

placing the inflatable bladder within an opening in the exterior side of a hull of the yacht from the exterior side of the hull of the yacht;

inflating the inflatable bladder by activating the activation device;

wherein activating of the activation devices causes the inflatable bladder to be inflated within the opening in the exterior side of the hull of the yacht using pressurized air from the gas canister thereby sealing the opening in the exterior side of the hull of the yacht.

14. The method of claim 13, wherein the activating of the activation device includes pulling a pull string.

15. The method of claim 13, wherein the activating of the activation device includes turning a hand valve.

16. The method of claim 13, further comprising, detaching the inflator device from the handle.

17. The method of claim 13, wherein an inflator device includes a Schrader valve in fluid connection with the hose; and further comprising:

detaching the inflator device from the handle;

attaching an air pump to the Schrader valve; and pumping the air pump to maintaining pressure in the inflatable bladder.

18. The method of claim 13, wherein the handle is a telescoping pole; and further comprising, prior reaching over a side of a yacht using the handle, extending a length of the telescoping pole.

19. The method of claim 13, wherein the inflatable bladder includes a safety pressure release valve; and further comprising releasing air from the inflatable bladder to prevent the inflatable bladder from becoming over inflated.

* * * * *